United States Patent [19]

Chasek

[11] 4,370,718

[45] Jan. 25, 1983

[54] RESPONSIVE TRAFFIC LIGHT CONTROL SYSTEM AND METHOD BASED ON CONSERVATION OF AGGREGATE MOMENTUM

[76] Inventor: Norman E. Chasek, 24 Briar Brae Rd., Stamford, Conn. 06903

[21] Appl. No.: 30,345

[22] Filed: Apr. 16, 1979

Related U.S. Application Data

[63] Continuation of Ser. No. 9,890, Feb. 6, 1979, abandoned, which is a continuation of Ser. No. 905,786, May 15, 1978, abandoned, which is a continuation of Ser. No. 702,091, Jul. 6, 1976, abandoned.

[51] Int. Cl.[3] ..... G08G 1/08

[52] U.S. Cl. ..... 364/436; 364/437; 364/438; 340/31 A; 340/38 R; 340/40

[58] Field of Search ..... 364/436, 437, 438; 340/35-37, 38 R, 40, 41 R, 43, 45, 31 A, 31 R

[56] References Cited

U.S. PATENT DOCUMENTS

| | | | |
|---|---|---|---|
| 3,258,744 | 6/1966 | Auer, Jr. | 340/37 |
| 3,397,306 | 8/1968 | Auer, Jr. | 340/37 |
| 3,414,876 | 12/1968 | Cress, Jr. et al. | 340/36 |
| 3,506,808 | 4/1970 | Riddle, Jr. et al. | 340/31 A |
| 3,602,880 | 8/1971 | Ueda | 340/31 A |
| 3,631,386 | 12/1971 | Saita et al. | 340/37 |
| 3,833,881 | 9/1974 | Drebinger et al. | 340/31 A |
| 3,836,965 | 9/1974 | Preti | 340/38 R |
| 3,906,438 | 9/1975 | Kohnert | 340/31 A |
| 3,920,967 | 11/1975 | Martin et al. | 364/437 |

*Primary Examiner*—Mark E. Nusbaum
*Assistant Examiner*—Gary Chin
*Attorney, Agent, or Firm*—Parmelee, Bollinger & Bramblett

[57] ABSTRACT

A system to improve traffic flow on all types of interconnected roadways, which reduces fuel consumption, emissions and trip times, is based on adaptive control of traffic signal timing. The parameters used to exercise this control are generated by sensing presence, duration, time, and velocity of vehicles passing a narrow road segment upstream from the signallized intersection and with intersections in proximity to each other, also downstream from that intersection. The information generated by each sensor is processed into three running aggregate quantities; aggregate momentum data, aggregate experienced congestion data and aggregate stopped vehicles data. A fourth quantity, triggered by tentative platoon identification, is based on velocity and density of a small sample of vehicles and speeds response time to an approaching platoon by pre-empting signal timing briefly. For intersections embedded in arterials and networks of roads, a fifth quantity is introduced by a pre-programmed clock, which acts to synchronize the timing offsets between adjacent intersections, to expedite traffic flow given the average traffic condition and other apriori information. The aggregate quantities are summed together in combinations determined by the traffic signal condition. The sums are compared with equivalent sums generated by processors associated with the intersecting roadway, generating a difference magnitude which in turn controls an adjustable rate clock, depending on existing signal conditions. A modification of this method for intersections of three or more roadways or for intersections including phased left-turn lanes is described.

28 Claims, 29 Drawing Figures

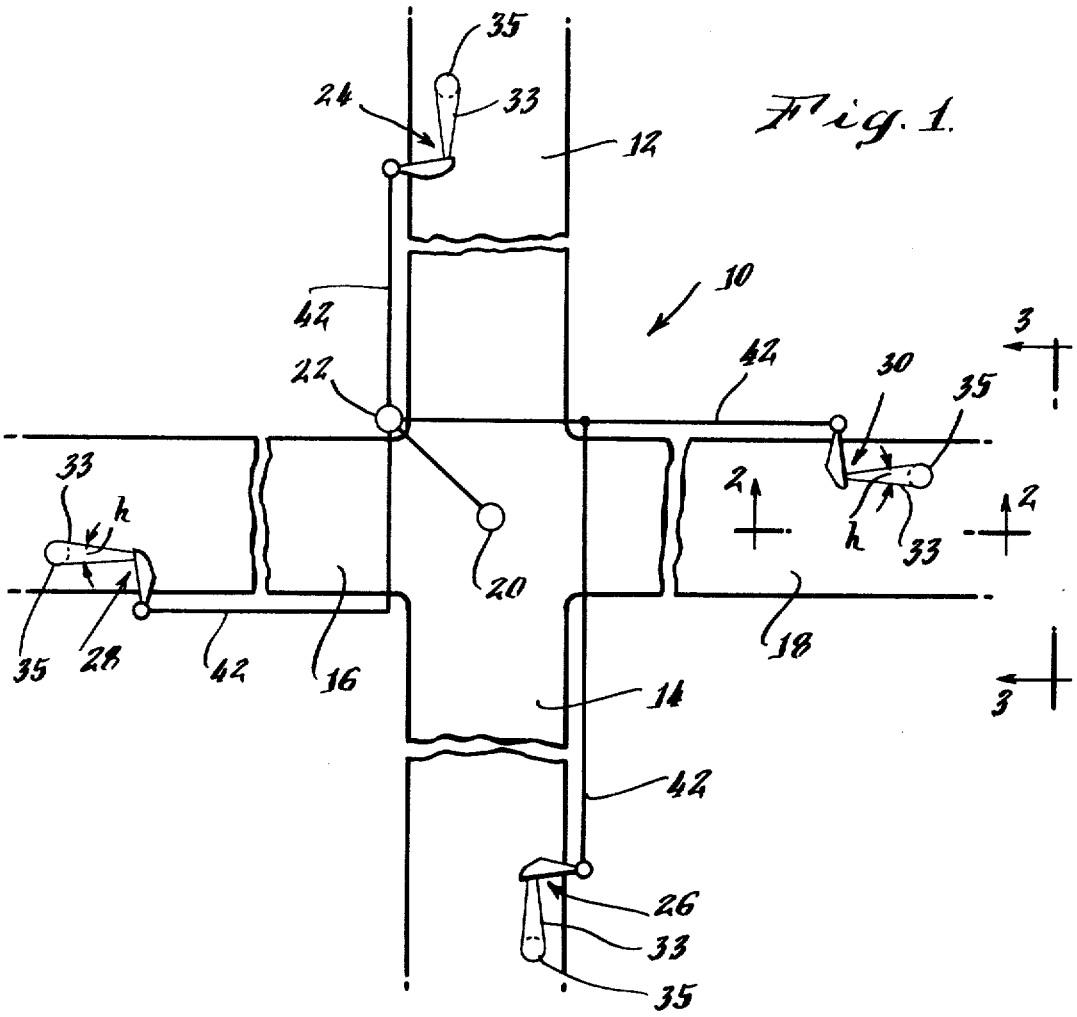
Fig. 1.
Fig. 3.
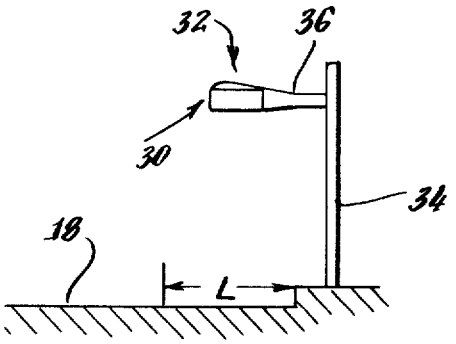
Fig. 2.
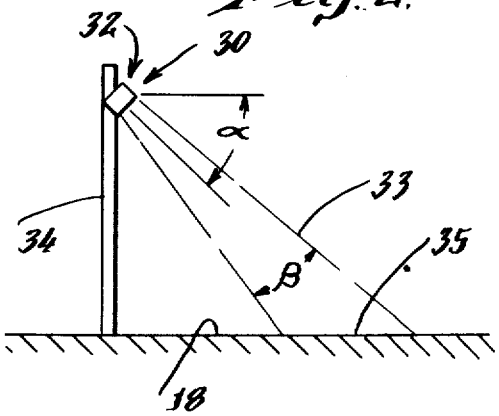

FOR SENSING HIGH DENSITY TRAFFIC AND FOR SHIFTING CONTROL CRITERION TO COMPARATIVE TRAFFIC DENSITY

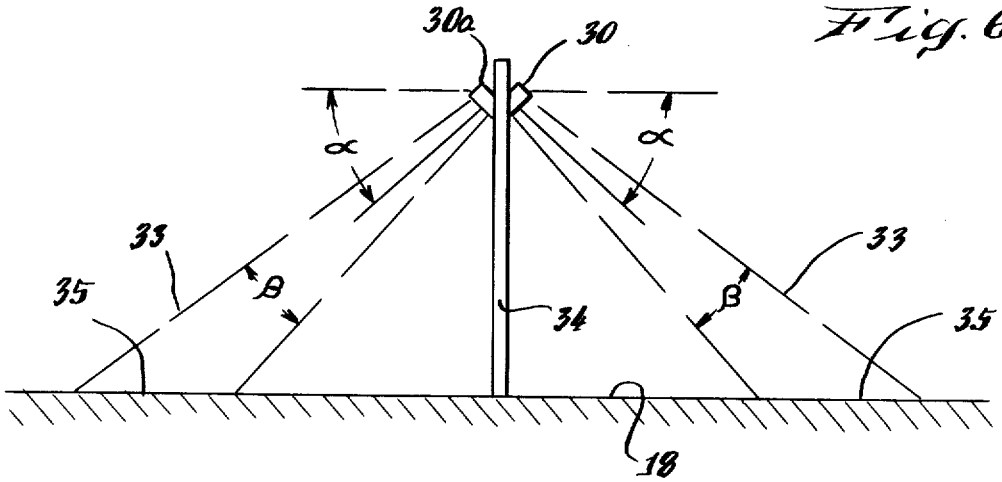
Fig. 6.
Fig. 7.
FOR SENSING HIGH DENSITY TRAFFIC AND FOR SHIFTING CONTROL CRITERION TO COMPARATIVE TRAFFIC DENSITY
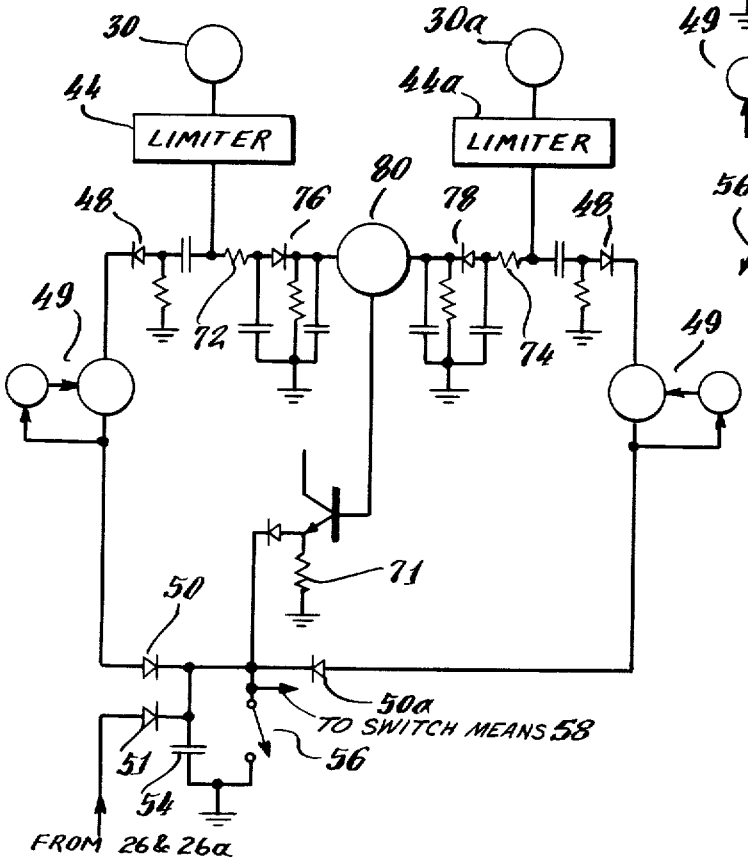
Fig. 8.
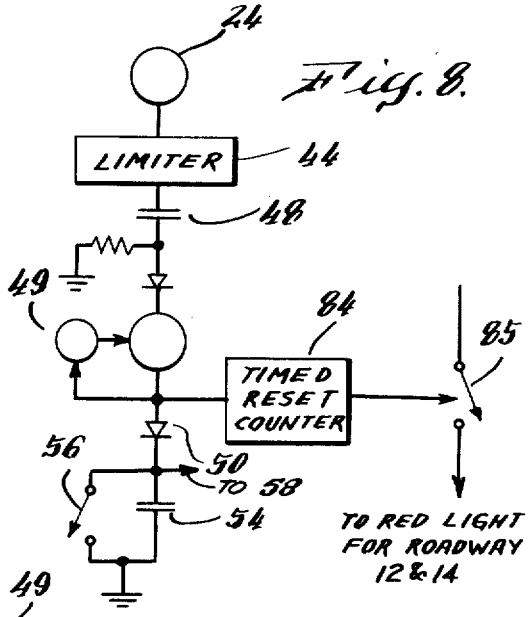
OPTIONAL CIRCUIT FOR AUTOMATICALLY STOPPING SPEEDERS Fig. 9.
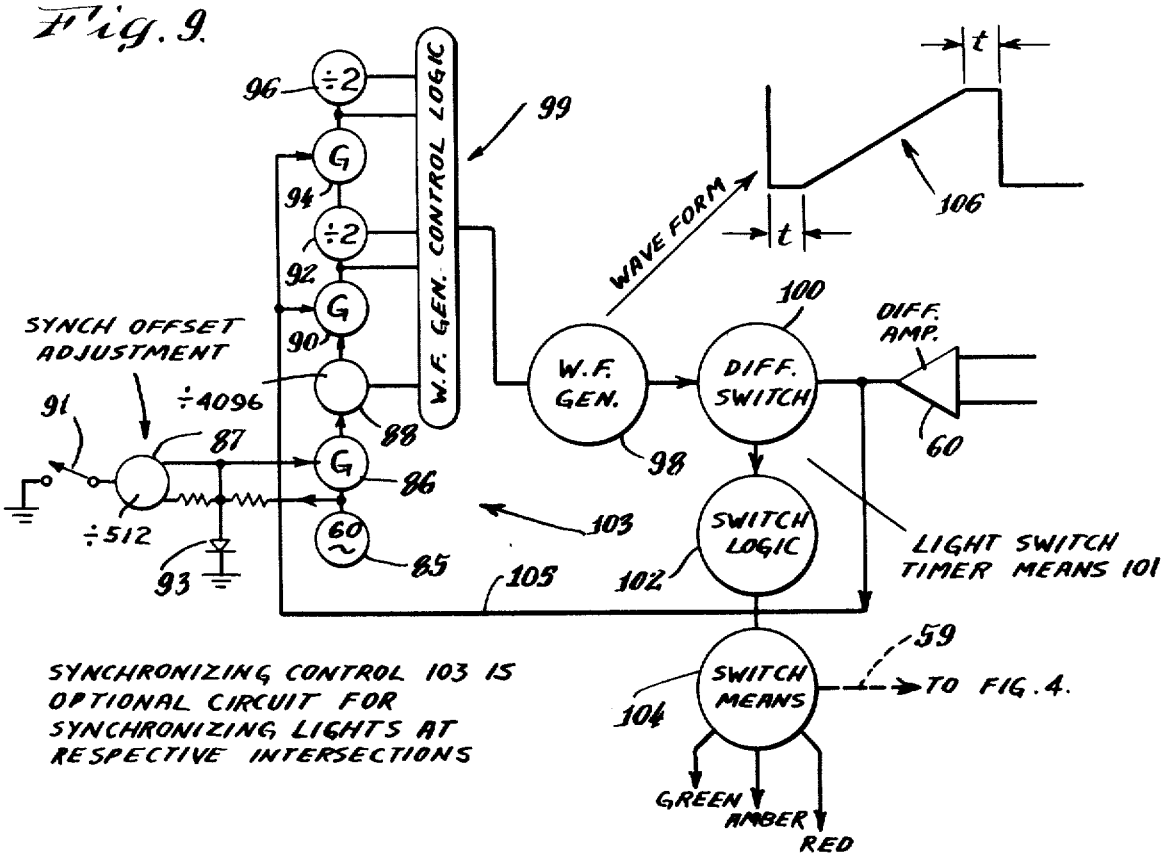
SYNCHRONIZING CONTROL 103 IS OPTIONAL CIRCUIT FOR SYNCHRONIZING LIGHTS AT RESPECTIVE INTERSECTIONS
Fig. 10.
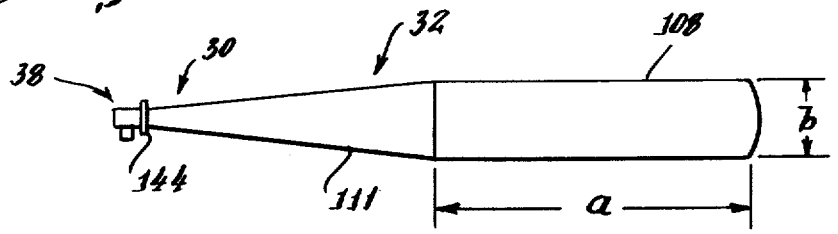
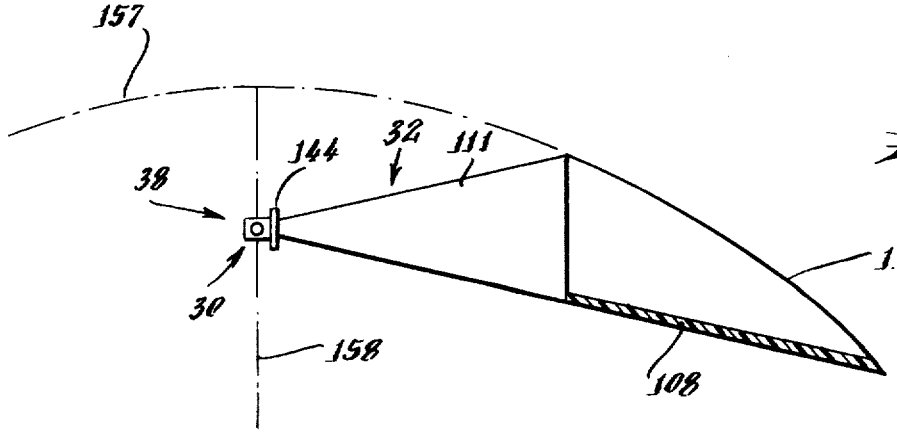
Fig. 11.

ΔP
PLATOON (TPI)
SYNC.
TIMER
TO SWITCHES
profile generator
Gate
inverter
flip flop
pulse burst generator
clock
time averaging circuit
differentiator
one shot multi-vibrator
limited count counter
running difference generator
decision element
traffic signal switching equipment
TPI
STOP1
STOP2
GO2 traffic profile generator
clock
Gate
flip flop divider
differentiator
tentitive platoon identification circuit
one shot multivibrator
decision element
running difference
sync offset timer
traffic signal switch equipment
"STOP1"
"STOP2"

RESPONSIVE TRAFFIC LIGHT CONTROL SYSTEM AND METHOD BASED ON CONSERVATION OF AGGREGATE MOMENTUM

RELATED APPLICATIONS

The present application is a continuation-in-part of copending application Ser. No. 009,890, filed Feb. 6, 1979; which, in turn, was a continuation of a copending application Ser. No. 905,786, filed May 15, 1978; which, in turn, was a continuation of copending original application Ser. No. 702,091, filed July 6, 1976; said respective copending applications have been subsequently abandoned.

BACKGROUND OF THE INVENTION

The foregoing background discussion relates to the embodiments of the invention as originally presented, whereas the following supplemental background discussion is for the improved embodiments of my invention which are additionally described in the present continuation-in-part application.

The importance of maintaining higher vehicular speeds and minimizing the number of vehicular stops is reflected in the following facts; increasing vehicular speeds from 10 to 20 mph improves fuel efficiency by 70%, and a vehicle travelling at 25 mph making one stop per mile increases fuel consumption by 25% and two stops per mile increases fuel consumption by 46%.

While the original specification recognized the significance of aggregate momentum as a readily measurable and comparable traffic parameter and also recognized the need to change over to a traffic density parameter during congested traffic conditions, the method of measuring and comparing aggregate momentum and density was not clearly developed. Furthermore, while the need to limit maximum "stop" time and minimum "go" time was recognized, the fact that stopped vehicles consume fuel and generate high emissions in proportion to their number was not recognized as a significant control parameter. Also the need to correlate cycle start times between interacting intersections, such as on arterials, by synchronization using adaptively controlled split timing was recognized. The method described, however, did not effectively contend with two way arterial flow and congested arterials.

Furthermore, in the measurement of Aggregate Momentum it was assumed that on the average, all vehicles could be assigned an average mass which would cancel out in numerical comparisons. Where trucks and buses comprise a significant proportion of the vehicle mix, on an arterial, for example, this assumption of equal mass is not a valid one, so an indication of vehicle size is necessary in the generation of Aggregate Momentum summations.

The original specification describes how suitable positioned upstream doppler radar velocity sensors can be used to generate aggregate momentum and traffic density information to control signal timing. Similar information could also be derived from other types of traffic sensors, particularly those that can indicate vehicular velocity and vehicular presence. The original specification describes sensors located only upstream from each intersection. It is desirable, as explained in the addendum specification, on non-isolated intersections also to sense downstream congestion as a factor in controlling timing of the traffic signals. Furthermore, the methods and systems described in the original specifications, depended on the time constants of summing capacitors to reflect the reduction in aggregate momentum as vehicles pass through the intersection on green or come to a stop at the intersection zone on red. Although capacitors can be utilized to advantage as described in the original specification, a number of additional advantages can be provided by digital computational forecasting, as will be described in detail farther below.

Traffic density in the original specification was determined using vehicular count rates or by the simultaneous presence of vehicles at two roadway locations. Computationally more compatible methods are described in the addendum specification to generate running sums indicating the congestion experienced by each vehicle.

The need for quick identification of platoons and the timely switching to a "go" signal so as to maintain platoon momentum was not fully recognized. Also the adaptation of these methods to three road intersections and left turn lanes was not included in the original specification. Also, certain practical problems of sensing these parameters with overhead doppler devices due to the widely scintillating returns was not recognized.

SUMMARY OF THE INVENTION

The foregoing summary relates to the embodiment of the invention as originally presented, whereas the following supplemental summary describes features, aspects, and advantages of the improved embodiments of my invention which are additionally described in the addendum specification.

The purpose of this invention is to realize a universally applicable method for controlling traffic signal timing that minimizes fuel consumption and emissions and yet can be relatively inexpensive and simple to install and maintain and also be safe. The method described by this invention positions sensors upstream, and in some cases, downstream, from each intersection where appropriate. The sensors generate vehicular velocity and vehicular presence data from which running sums of aggregate momentum, aggregate congestion and aggregate stopped vehicles are generated. Which quantities are summed at any time depend on signal color. These running sums are compared between intersecting roadways and used to appropriately lengthen the "go" signal with respect to the "stop" signal for that roadway with the greater sum.

Aggregate momentum, as described in the original specification, can be most conveniently approximated by the running sum of each vehicle's velocity times its length instead of mass, and this running sum is continuously corrected by computational means for vehicles that pass through the intersection. These corrections use the velocity data available from the sensor. The experienced aggregate congestion is best represented by the running sum of an inverse velocity factor times a vehicle length factor. The aggregate stopped vehicles is best represented by counting the numbers of stopped vehicles at the intersection and multiplying that number with an empirical constant.

For intersections that are sufficiently close as to interact, the downstream aggregate congestion factor is subtracted from the upstream running sum for that roadway. This introduces downstream congestion as a factor in an upstream intersection's timing control. Once suitable running sums are compared, the difference magnitude is used for a timing control method that uses a clock, logic circuits and suitable frequency dividers so that when a given roadway has a "stop" signal and also the larger running sum, above a specified minimum, the effective clock rate is sped up. When the running differences are small, the clock rate remains nominal and produces a 50% split. Platoons are tentatively identified from a limited traffic sample by their velocity and density and the timing is pre-empted for short periods to help insure a timely switch to green to maintain platoon speed.

It is an advantage of the further embodiments that they provide background progressive synchronization along arterials which pre-empts timing control during periods of light traffic, as sensed when the averaged sum of aggregate momentum and aggregate congestion fall below certain levels. The synchronized offsets can be set to favor certain directions for certain times of the day.

When the aggregate momentum plus aggregate congestion increases above other levels, the split is adjusted to reflect this traffic condition by means of the running sum comparisons previously described. As aggregate congestion increases above certain levels along arterials, or networks, those intersections experiencing that congestion switch in a pre-empted, common timed, block synchronization. The block synchronization is eliminated when aggregate momentum levels rise above certain minimum prescribed levels as sampled every several minutes.

In addition, a means for adaptively controlling three way intersections or roadways with left turn lanes is described in which the "go" signal timer rate is inversely controlled by the difference between that "go" running sum and the fractionally weighted grand running sum of all the other roadways or lanes, and the sequence can skip a "go" phase when no traffic is present on that roadway or lane.

BRIEF DESCRIPTION OF FIGURES

FIG. 1 is a plan view of a four-way street intersection having a traffic light control system embodying the invention and employing the method of the invention;

FIG. 2 is an enlarged elevational view taken along the line 2—2 in FIG. 1;

FIG. 3 is another enlarged elevational view taken along the line 3—3 in FIG. 1;

FIG. 6 is an enlarged elevational view taken along line 2—2 in FIG. 1 but showing a double doppler sensor for gauging traffic density;

FIG. 7 is a circuit diagram of means for sensing a high traffic density condition when using the double doppler sensor and for shifting the control criterion from conservation of aggregate momentum to comparative traffic density;

FIG. 8 is a circuit diagram of means for turning on the red light for speed violators;

FIG. 9 shows a schematic electrical circuit diagram of a circuit which controls the relative time duration of red and green lights and which synchronizes one light switch transition occurring at a plurality of intersections while allowing the second light switch transition to be controlled by traffic conditions occurring at the respective intersections;

FIG. 10 is a bottom plan view of a preferred doppler sensor with antenna and source/mixer assembled together;

FIG. 11 is a side elevational view of the doppler sensor assembly of FIG. 10;

FIG. **13*a* is a block diagram illustrating control philosophy

FIG. **19*a*** illustrates a method of estimating vehicular duration time in the sensed zone.

Figures 20, 20A:
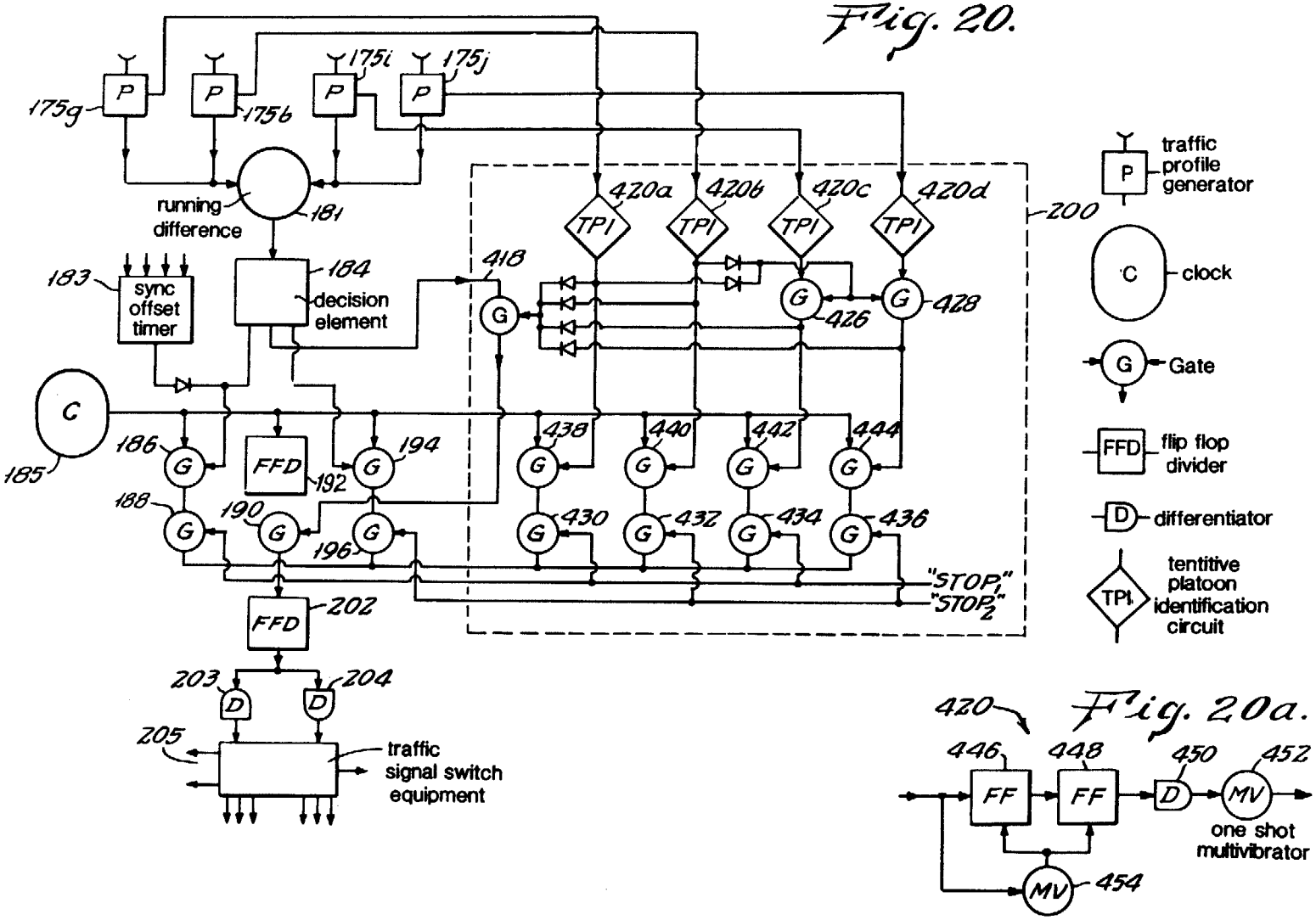

FIG. 20 is a block diagram describing a means for controlling timing and for tentatively identifying platoons and taking pre-emptory control of the timing, in this case illustrated for the isolated intersection of two major roadways.

FIG. **20*a*** is a block diagram illustrating a tentative platoon identification means.

Figure 21:
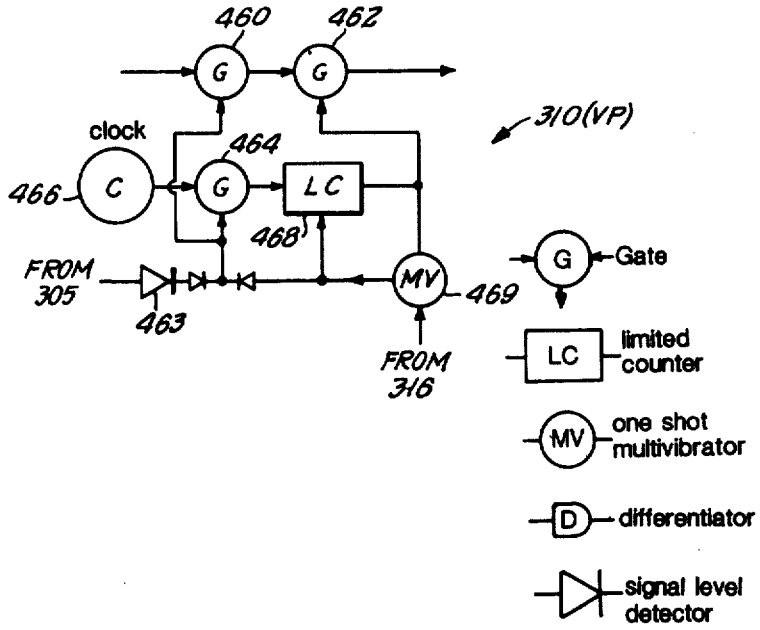

FIG. 21 is a block diagram that illustrates a preferred method for generating velocity information from a widely fluctuating doppler signal.

Figure 22:
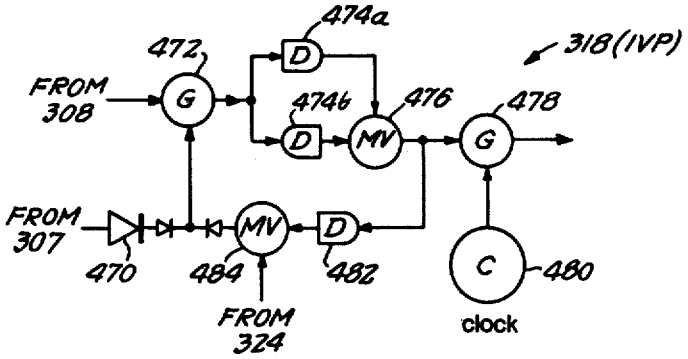

FIG. 22 is a block diagram which illustrates a preferred method for generating numerical inverse velocity information from a doppler radar signal.

DETAILED DESCRIPTION OF PREFERRED EMBODIMENTS

The optimization of vehicular flow to minimize fuel consumption and auto emissions involves the optimization of 3 novel traffic parameters. One of the parameters employed by the traffic control methods and systems embodying this invention is aggregate momentums, AM, which is represented by the running sum of vehicular momentums existing, at any instant, between a sensed zone and an intersection. Since vehicular mass is a constituent of momentum that cannot be conveniently measured, the preferred embodiment of this invention uses vehicular length as an equivalence to mass.

A second parameter employed by this invention is aggregate experienced congestion or AEC. AEC indicates the congestion experienced by each vehicle as measured preferably by a running sum of inverse velocity factors for each vehicle between a sensed zone and an intersection. This running sum operates during "go" signal conditions. An accounting for vehicular length should be included in AEC since five trucks traveling at a given velocity would, by this measure, indicate the same congestion as five small vehicles traveling at the same speed, whereas in reality the five trucks would represent a greater degree of congestion and should get the greater priority. The precise relation that vehicular length should play in the AEC factor will depend on further traffic studies. For illustrative purposes, vehicular length will be used as a direct multiplier.

A third parameter employed by this invention is referred to as aggregate stopped vehicles or ASV. When a vehicle is stopped at an intersection by the traffic signal, that vehicle uses fuel and generates emissions. This fact can be expressed by multiplying the number of stopped vehicles times an empirically derived constant. ASV is operative during "stop" signal conditions and for a period of time after the switch to a "go" signal to provide time to clear out the stopped vehicles.

An important aspect of this invention is that all three parameters can be interchangeably summed and compared in a compatible and meaningful way.

A traffic profile, P, which characterizes the dynamic traffic condition of a single isolated lane is the running sum of the three parameters AM, AEC, and ASV in which $$AM = \sum_n V_n \left( \frac{T_m - t}{T_m} \right)^{1-C} C \sum_n V_n e^{\left(\frac{t-T_m}{t}\right)} \quad o \leqq t \leqq T_m$$

where $V_n$ is the average velocity of each vehicle between a sensed zone and the intersection.

C is 0 on "stop" signal and amber, and C is 1 on a "go" signal.

$T_m$ is the calculated time it should take each vehicle to pass from the sensed zone to the intersection.

t is the running time variable for each vehicle, equaling zero when it passes the sensed zone and equaling $T_m$ when it enters the intersection.

This equation indicates that the average velocity of each vehicle between the sensed and intersection zones adds onto the running sum when it passes the sensed zone and then is subtracted out, or netting zero, when it passes through the intersection during a "go" signal condition. On a "stop" signal condition, the velocity is gradually reduced to zero as that vehicle approaches the intersection zone and stops.

$$AEC = C \sum_n \frac{V_o^2}{1 + V_n} - C \sum_n \frac{V_o^2}{1 + V_n} e^{\left(\frac{t-T_m}{t}\right)} \quad o \leqq t \leqq T_m$$

$V_o$ is a transitional velocity, below which traffic is considered to be congested. When a vehicle passes the sensed zone during "go" signal conditions, it adds to the running sum a quantity $V_o^2/(1+V_n)$ and when that vehicle passes through the intersection, this contribution is cancelled. When the signal switches to an amber and "stop" condition, the entire summation goes to zero.

$$ASV = \sum_n N_m K - C \sum_n N_m K \frac{t'}{T_o} \quad o \leqq t' \leqq T_o$$

where $\sum_m N_m$ is the number of vehicles that have stopped and are waiting at a "stop" signal.

K is the empirical derived constant relating stopped traffic fuel consumption and pollution to that of moving traffic.

$T_o$ is the estimated time necessary to clear the stopped vehicles through the intersection after the signal switches to "go".

t' is the real time variable. It is the running time after the traffic signal changes to "go" until the intersection becomes cleared. The traffic light changes to "go" at time t' equals zero.

The ASV summing process typically begins when the signal switches to amber and it stops after the signal switches to "go". The ASV count is gradually cleared after the signal switches to "go", and remains at zero until the next switch to amber when a new count begins to accumulate.

These equations express, mathematically, how this system operates.

Figure 12:
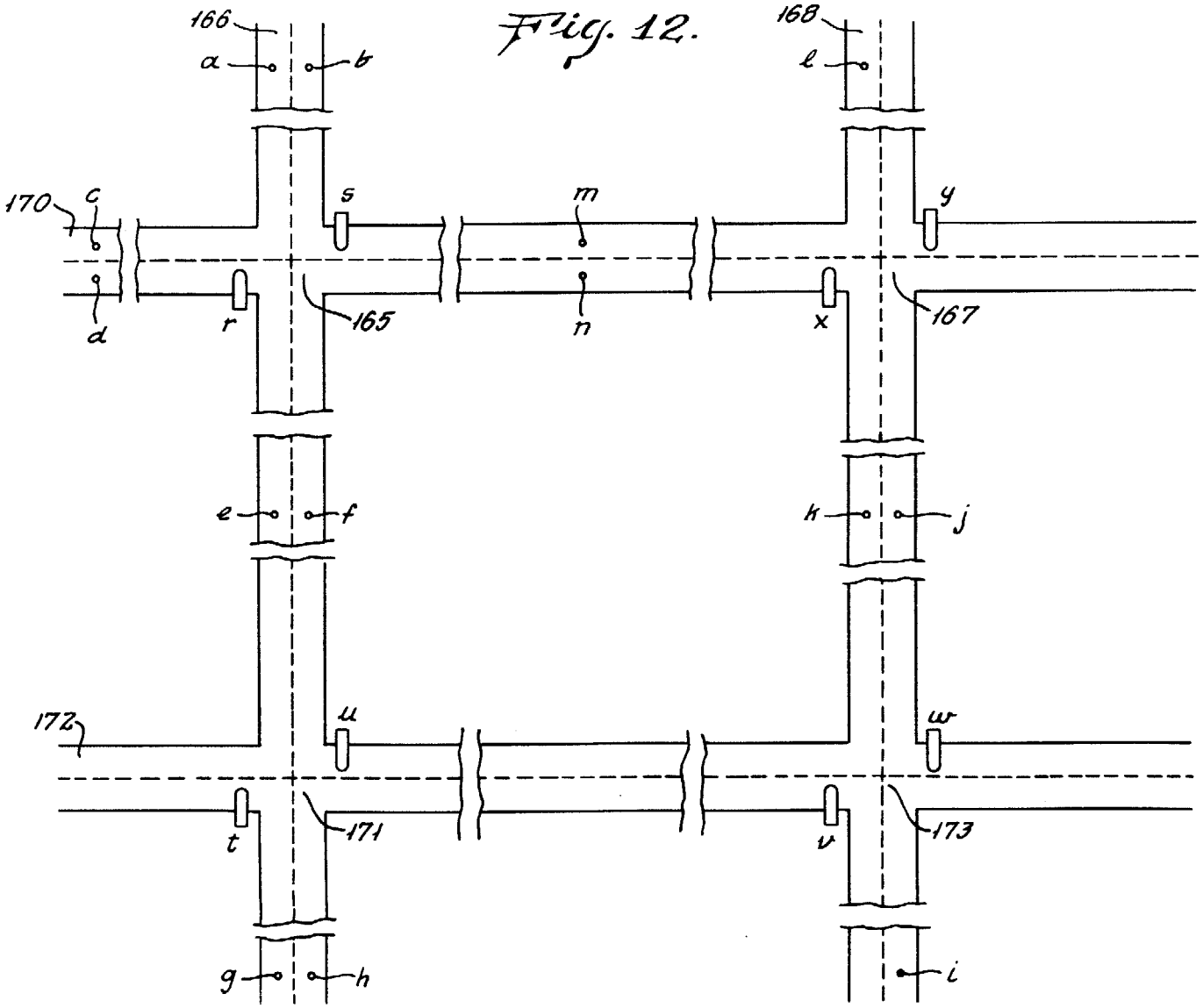
FIG. 12 is a plan view of four interacting intersections used to illustrate how sensors can be positioned.

The deployment of sensors in the vicinity of an intersection depends on the nature of the intersection. FIG. 12 illustrates four possible intersection types of the many that can exist. For example, if the distance to a subsequent intersection is large, i.e., more than 1,000 feet, then that intersection is considered as isolated and only upstream sensors need be deployed. If the distance to subsequent intersections is substantially less than 1,000 feet, the intersection is considered as interactive and both downstream and upstream sensors should be used, with the downstream sensor for one intersection often serving as the upstream sensor for the next intersection. If the intersections are separated by less than 200 feet, for example, the two intersections are considered as coupled and can be treated as a single intersection. A presence sensor located directly at the intersection may be necessary for an accurate stopped vehicle count, particularly where right turn on red is permissable, or where errors in stopped vehicle count that produce zero counts when there are actually vehicles waiting at the intersection might cause disruptions.

The following description of FIGS. 1–11 is a description of the invention as originally presented in the first related patent application identified above under the heading RELATED APPLICATIONS. If the reader wishes to continue reading about the improved embodiments of this invention, then please begin reading where the description is directed to FIG. 12.

An illustrative example of a traffic light control system embodying the invention and for practicing the method of the invention is shown in FIG. 1. At the intersection 10 of four roadways 12, 14, 16 and 18 is a traffic light 20 which is controlled by control box 22. Attached to overhead cross members located at an optimum distance from the intersection 10 are four doppler sensors 24, 26, 28 and 30.

The optimum location of the doppler sensors from intersection 10 is a compromise of two conditions. The location should be far enough away from the intersection to minimize the perturbing effect of the red light on traffic speed and density; a distance greater than where the average motorist starts braking when he sees a red light. The sensor location should, however, be close enough to the intersection so that there are no other significant traffic entry points between the sensor and the intersection and also close enough to sense heavy stop-and-go traffic build-ups that have become a significant irritant to motorists. Typically the optimum location will lie in a range from approximately 200 to 500 feet from the intersection depending upon local conditions, for example, 300 feet is a representative optimum distance.

As shown in FIG. 2, each doppler sensor, such as sensor 30 includes an antenna 32 directing a radio beam 33 with a horizontal beamwidth h (FIG. 1) that restricts the sensing area, i.e., visibility, of the sensor 30 to one traffic lane. This horizontal beamwidth should typically be no more than 5° for a sensor 30 mounted at a height in the range from 20 feet to 30 feet above the roadway 18. The beam 33 can be aimed either upstream or downstream. In the example in FIG. 1 the beams 33 are pointed upstream.

FIG. 2 shows a cross section of the radio beam 33 from the doppler sensor indicating the vertical beamwidth B. The downward inclination angle, $\alpha$, that the median line of the vertical beamwidth makes with the horizontal is preferred to be approximately 45°. If this angle becomes much greater than 45°, the area of impact 35 of the doppler radar beam onto the roadway becomes too small. If the angle is much less than 45°, the horizontal lane occupancy of the beamwidth becomes too great and information from the wrong lanes may be detected. Also the distance at which vehicles have to be sensed becomes greater, and thus more sensitive sensors may be required that might respond to opposite flow lanes. The vertical antenna beamwidth B should be greater than 5°, for example in the range from 7° to 20°.

FIG. 3 shows the sensor 30 positioned approximately over the center of the approach lane L of the roadway 18. Such an overhead position reduces pickup from opposing lanes. FIG. 3 shows the antenna 32, an existing utility pole 34 with a cross member 36 that positions the sensor antenna near the mid point of the lane L being checked. If there were two lanes to be checked, then two antennas would be used, positioned over each lane. Each doppler sensor 24, 26, 28 and 30 is connected to the control circuitry located in the control box 22 by a two wire line 42.

Figure 4:
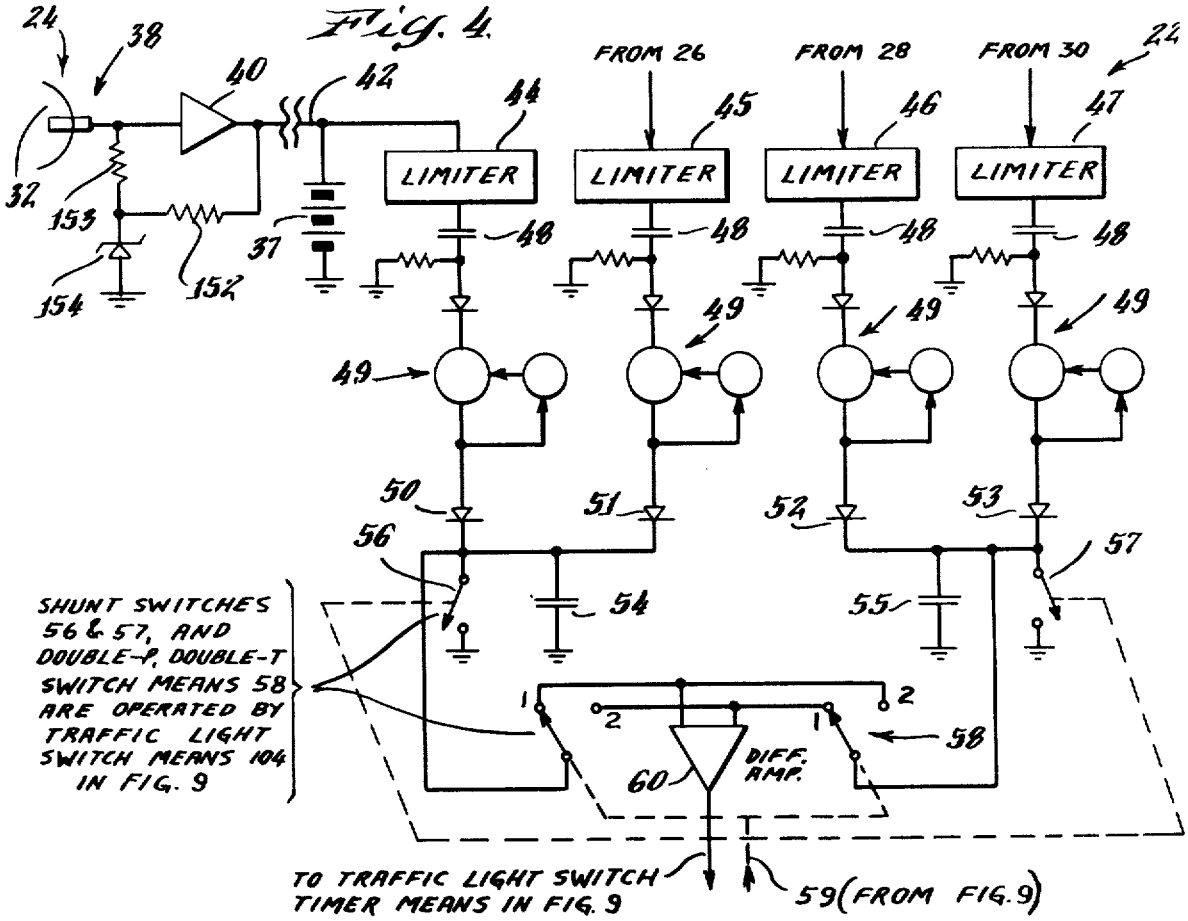
FIG. 4 is a schematic electrical circuit diagram of the traffic light control system as shown in FIG. 1.
Figure 5:
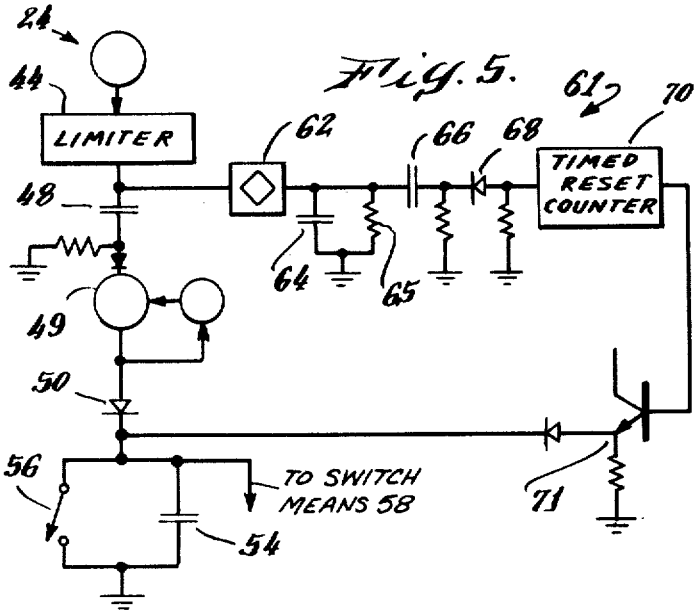
FIG. 5 is a diagram of means for sensing a high density traffic condition and for shifting the control criterion from conservation of aggregate momentum to comparative traffic density when using a single doppler sensor.

FIG. 4 shows a schematic electrical circuit diagram of the sensor and control apparatus. The antenna 32 beams energy from and receives reflected energy back to the doppler source/mixer 38. This doppler source/mixer 38 may include a single diode, for example, such as a tunnel diode, Gunn diode, Barritt diode or a field effect transistor, which acts to both generate the microwave energy and to mix the returned doppler shifted energy with the original signal source to produce an audio frequency beat. The doppler source/mixer 38 can also use a mixer diode in addition to the microwave energy source. It is my present preference to use a tunnel diode in an assembly as shown in FIGS. 12, 12A, 12B and 13 as being particularly advantageous; but it is to be understood by the reader that the doppler source/mixer 38 may comprise any suitable device for use in a doppler radar sensor 24, 26, 28, 30 or 30A.

The direct current (d.c.) energizing power for each amplifier 40 and for each doppler source/mixer 38 is a power supply 37 (FIG. 4) located in the control box 22. This power supply 37 is connected to the two-wire line 42 for feeding electrical power over the line 42 to the amplifier 40 and to source/mixer 38. It is to be understood (but now shown in FIG. 4) that d.c. energizing power is similarly being fed over the other lines 42 to the other remotely located doppler radar sensors 26, 28 and 30.

The best arrangement is dictated by the size of the antenna and the typical doppler cross section of traffic encountered in the traffic lane being sensed so that an adequate return is received from the typical vehicle, with negligible returns being received from adjacent lanes. The audio frequency from the doppler radar sensor 24, 26, 28 or 30 is amplified in an amplifier 40 and this signal is brought back to the controller 22 by the two-wire line 42. Each wire line 42 from each sensor feeds a pulse-shaping circuit including a limiter 44, 45, 46 and 47, respectively, consisting of a series of clipper diodes and amplifiers which then each feed a differentiating circuit 48. The limiter 44, 45, 46 or 47 removes all fluctuations in amplitude due to varying vehicular radar cross sections for producing sequences of pulses of equal amplitude, the frequency of each sequence being representative of the speed of the respective vehicle being sensed.

Each differentiating circuit 48 generates pulses whose repetition rate is a function of the velocity of the particular vehicle being sensed. These pulses trigger a time-gated one-shot multivibrator 49. A time-gated one-shot multivibrator is defined as a one-shot multivibrator that once activated, operates as a one-shot multivibrator for "n" seconds after the initial change of state occurs and then is turned off by a timer for "m" seconds so that the presence of input doppler signals can no longer activate the multivibrator. After "m" seconds have past, the multivibrator reverts to its normal state in which it again responds to the presence of input pulses from the differentiating circuit 48. This time-gated multivibrator accepts pulses for an "open" period "n", i.e., approximately 0.1 seconds, after the first pulse arrives. The gate then closes for "closed" period "m", i.e., approximately 2 seconds.

Figure 4A:
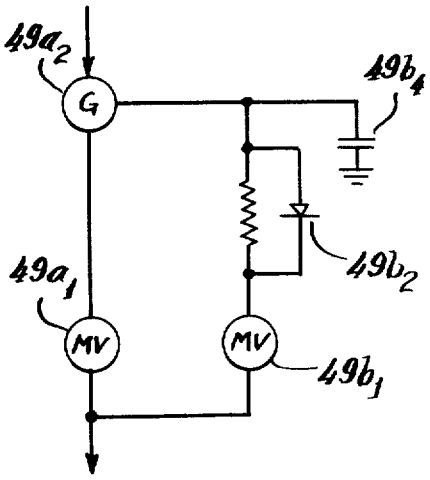
FIG. 4A is a block diagram of time-gated-one-shot multivibrator.

One means of realizing a time-gated one-shot-multivibrator is described in FIG. 4A. It consists of a voltage sensitive threshold gate, $49a_2$ and a one-shot multivibrator $49a_1$ in series. The output of $49a_1$ is tapped and fed into multivibrator $49b_1$ whose "on" time is n+m seconds. The output of $49b_1$ feeds an integrating circuit that reaches the thres-hold voltage of gate $49a_2$ in n seconds. When multivibrator $49b_1$ turns off, the capacitor $49b_4$ rapidly discharges through diode $49b_2$ and the cycle is ready to be reinitiated. Gate $49a_2$ normally passes signals except when a voltage exceeding its threshold is applied from capacitor $49b_4$. When this threshold is reached or exceeded the gate will not pass signals.

These gate times "n" and "m" are selected to get a fixed representative time sample of returns (sequence of pulses) from a vehicle and then to close down and allow the vehicle completely to pass. The frequency of these pulses is proportional to the velocity of the vehicle or at least is accurately representative of its velocity. Normally the more powerful returns from a vehicle will come from the sloping front windshield areas and from radiator grills for upstream aimed sensors, and will come from the rear window areas and trunks for downstream aimed sensors. A vertical beamwidth of 10°, for example is usually sufficiently great to keep the vehicle in its view for a long enough period to get the desired velocity sample.

The outputs from the time-gated-multivibrator 49 feed series diodes 50, 51, 52, and 53. Diodes 50 and 51, associated with the pair of colinear roadways 12 and 14, feed a common integrating capacitor, 54. Diodes 52 and 53, associated with the other pair of colinear roadways 16 and 18 feed a second common integrating capacitor 55. The charging and discharging time constants of capacitors 54 and 55 are empirically derived but are intended to be very slow in order to integrate aggregate momentum over suitably long periods. The voltage build-up across each capacitor 54 and 55 is proportional to the total number of pulses fed into the capacitor during a time period equal to its discharge time constant. In effect, these capacitors 54 and 55 serve as summing means, and this voltage on them is proportional to the summation of the respective velocities of the various vehicles which are served when they are passing through the various sensor beams 33.

The product of the number of vehicles and their average velocity, i.e., the summation of these average velocities, is approximately equal to the aggregate momentum of the traffic flow. It may not exactly be equal to the aggregate momentum because of differences in the mass of the individual vehicles, but in average this capacitor voltage is approximately equal to A.M. Switches 56 and 57 shunt capacitors 54 and 55. These switches are normally open and close briefly when the light changes color. When the switches close, the capacitors 54 and 55 become completely discharged so that the control cycle can begin afresh. The outputs of capacitor 54 and 55 feed into a double-pole double-throw switch 58 which in turn feeds a differential amplifier 60.

As shown in FIG. 9, the differential amplifier 60 is connected to light switch timer means 101, for example, this timer means may include a differential switch 100, a waveform generator 98 and a switch logic microprocessor 102. This switch logic microprocessor 102 is connected to the switch means 104 for controlling the relative time duration of the "green" or "go" and "red" or "stop" signals of the traffic control means 20 (FIG. 1). The traffic light control switch means 104 (FIG. 9) activates switch 58 through interconnection means 59 (which may be an electrical interconnection when solid-state switch means are being used or may be a mechanical linkage interconnection when mechanical switches are being used). If the light 20 controlling colinear roadways 12 and 14 is red, then switch 58 is in position 1.

The connection to the differential amplifier 60 is such that, when switch 58 is in position 1, and if a higher voltage exists across capacitor 54 than 55, then the light timer will speed up for the purpose of shortening the length of time that the "red" light is on for the colinear roadways 12 and 14. If the higher voltage is across 55, then the timer will slow down for lengthening the time that the "green" light is on for the other colinear roadways 16 and 18. When the light associated with roadways 12 and 14 is green, then the switch 58 is put in position 2, and the opposite reactions occur.

There are maximum and minimum time limits preset for both red and green. These limits are set by the limits of the differential amplifier 60. Such limits assure that there are no very long time periods on red or green so that a vehicle waiting for a light to change will not be held for an intolerably long time. Also the green is on long enough to allow at least one or two vehicles to accelerate and to cross the intersection.

When traffic flow reaches a certain critical density in the vicinity of any sensor 24, 26, 28 or 30 the conservation of A.M. as a controlling premise or criterion is overridden, and only the relative traffic density then controls the timer. A traffic density sensing circuit 61 (FIG. 5) illustrates one possible means for accomplishing this objective. The output from any one of the limiters, for example the limiter 44, is full-wave rectified by a full-wave rectifier 62 and fed into a charging capacitor 64 having a fairly rapid discharge rate through resistor 65. When a vehicle is sensed, this capacitor is charged up. The slower the vehicle, the greater the charge build up because the slower vehicle remains in the sensed area 35 (FIG. 1) for a longer time. When no doppler signals are received, the capacitor discharges. This discharging voltage is differentiated by a differentiating circuit 66 and fed through a diode 68 that passes the negative discharge voltage into a counter 70. The counter is a three stage flip-flop that counts to 8. If an 8 count is reached in a predetermined time, for example "p" seconds,* a large voltage appears at the counter output. If the count does not reach 8 in "p" seconds, the counter is reset to zero.

*"p" is an empirically derived time such that if three vehicles are sensed, the traffic density has reached the critical density.

When the count does reach 8 before the reset time, the large output voltage is fed into capacitor 54 through a low impedance charging circuit 71. This circuit 71 effectively captures control of the voltage on capacitor 54 and therefore pushes the timer towards its maximum green light limit and minimum red light limit. The faster the 8 count is reached before the reset, the greater the traffic density. The integrated charge current fed into capacitor 54 is higher and the light timer is pushed closer to its maximum green and minimum red limits. If the density on both intersections are nearly equal then equal timing of red and green will result.

Such a means 61 (FIG. 5) of gauging traffic density is susceptible to the uncertainties of vehicular cross sections and the other vagaries of this traffic flow medium, such as very slow stop-and-go traffic. A more positive method of gauging traffic density is to use a twin doppler sensor, as shown in FIG. 6, with one beam pointed upstream and one beam downstream. When vehicles are sensed simultaneously by both beams, then the traffic has reached a critical density and the conservation of A.M. is then overridden as a control criterion. This twin doppler sensor system is more expensive than the single doppler sensor system but it provides a more positive measure of traffic density and also provides a redundancy of equipment in case of sensor failure. Further redundancy is achieved because both the front and rear aspects of each vehicle are viewed. This double viewing assures a more positive vehicle sensing without using an over sensitive sensor which might respond to adjacent lanes. FIG. 6 shows the two sensors, 30 and **30*a*** pointed upsteam and pointed downstream respectively.

FIG. 7 shows the circuit that uses the information from both sensors to override the conservation of A.M. control premise. The output from both limiters, 44 and **44*a*, is fed through RC circuits 72 and 74, respectively, and then into integrating circuits 76 and 78 with discharge time constants of the order of one second. The respective voltages across each capacitor are fed into a coincidence gate 80. When a voltage of approximately the same magnitude is present on both sides of the coincidence gate, the gate opens and feeds its voltage through low impedance charging circuit 71 into integrating capacitor 54. The time constant of this charging circuit 71 is much shorter than that of the conservation of momentum charging circuit (FIG. 4) and therefore this latter circuit tends to take over control of the light timers during the periods of high traffic density in the vicinity of the twin doppler sensors 30, 30***a*. The RC circuit 72 or 74 discriminates against a very high speed vehicle that may cross both sensors within the time constant of the integrating circuits 76 and 78. The longer the time intervals that vehicles are simultaneously being sensed by both doppler sensors, the stronger the light control takeover.

There is an optional safety feature that can be incorporated into this light control system so that any vehicle that exceeds the speed limit by a given amount, will automatically get a red light. FIG. 8 shows a circuit that accomplishes this automatic red light for speeders. The output of the time-gated one-shot-multivibrator 49 is fed into a counter, 84 having a fixed preset time interval and a switch activator. For example, this preset time interval may be 0.05 seconds. If the pulse count reaches or exceeds the limit of the counter in this time interval, this count limit indicates a speeder. Then the red light is instantly turned on by actuation of an overridding switch 85 which is connected in the red light energizing circuit. This red light turn-on is for a brief period and then the system reverts back to its normal timing sequence.

The relation between the output voltage from differential amplifier 60 and the change in rate of the traffic light timing can only be determined by studies and experimentation. The relationship will be a variable one that can be adjusted for different installations.

The synchronization of one switch cycle at a plurality of intersections is achieved by the apparatus shown in FIG. 9. The output from the differential amplifier 60, which is controlled by traffic conditions, feeds one side of differential switch 100. The other side of differential switch 100 is fed by a waveform generator 98 whose waveform is 106. The wavefrom is a sawtooth with clipped top and bottom points. The clip duration is "t" seconds. This time "t" sets the minimum time that a light can be red or green. This time "t" is set to forestall impractically short duration times for one color. The minimum voltage of waveform 106 is zero and the maximum is set to coincide with the approximate maximum level from differential amplifier 60. When the voltage of waveform 106 exceeds the voltage out of 60, a switch transition occurs in 100. The next switch transition occurs when the waveform returns to zero. This transition, at the return to zero, is synchronized between intersections by the synchronizing control circuit 103 which is connected into a waveform control logic circuit 99 for controlling the waveform generator 98. The output from the differential switch 100 is a pulse which is fed into the switch logic circuit 102 to indicate the time of the red-green light switching. The switch logic circuit 102 incorporates the amber light timing, red-green overlap, etc. The output of circuit 102 operates the respective red, green and amber light switches located in the light switching means 104.

Synchronized timing is derived from the synchronization circuits 103 shown to the left of waveform generator 98. The basic timing is conveniently derived from the power lines 85 whose voltage is at the 60 Hz power line frequency. This voltage is available at all intersections. The 60 Hz signal passes through gate 86 before it can actuate the microprocessor 88 which is a divide by 4096 circuit providing a minimum time base of 1.14 seconds for waveform 106. Gate 86 is opened by the output voltage from synchronization offset adjustment circuit 87, which is a divide by 512 series of flip-flops. This circuit 87 provides an adjustable timing offset between intersections, if an offset is desired.

When the count reaches the last flip-flop stage in circuit 87, the voltage generated at the output, short circuits a shunt diode 93 and immediately stops the a.c. signal which was previously flowing from lines 85 into the circuit 87. This same voltage also opens gate 85 which allows the count to be picked up in the divide by 4096 circuit 88. Switch 91 is used for adjusting the amount of offset by predetermined time increments. In this example the switch 91 provides an incremental. adjustment of 8.53 seconds in the offset between intersections. For example, if the synchronized switch transition must be offset by one minute between two consecutive intersections, then switch 91, should be opened and closed seven times. This opening and closing of switch 91 introduces a fixed sixty second timing offset between the two consecutive intersections, and so forth for other offsets.

When the output from differential amplifier 60 is low, then the ÷4096 or basic 1.14 minute time base is used. As the voltage from the differential amplifier 60 increases, an extention of the time cycle is provided, as will be explained.

When the voltage from differential amplifier 60 fed over lead 105 exceeds the threshold level of gate 90, this gate is opened and then a divide by 2 circuit 92 takes over control of the timing cycle, through the "or" gate logic circuit in 99 extending it to 2.28 minutes by correspondingly lengthening the time duration of the truncated sawtooth waveform 106.

When the voltage out of differential amplifier 60 increases further, indicating the need for an even longer time base, the threshold on gate 94 is exceeded and the divide by two circuit 96 additionally takes over control through 99. This latter action extends the time cycle to 4.55 minutes. For example, assuming that the clip duration "t" on the waveform 106 is 15 seconds, then the light can be green in one direction for 4.30 minutes and red in that direction for only 15 seconds. This would occur when extreme traffic conditions exist between intersections. All of the time examples given in this illustrative example can be changed to meet any requirement. The combination of the modified sawtooth 106 and the threshold gates 90 and 94 provide a continuously variable timing adjustment from 15 seconds to 4.55 minutes.

As indicated above, the control circuit 99 is a logic circuit which controls the time duration of the truncoted sawtooth waveform 106 produced by the generator 98.

There are several doppler radar sensors 24, 26, 28, 30 and 30*a* that can be used for such a light control system, as mentioned above. The present preference is for the unit shown in FIGS. 10 through 13 for the following reasons: The antenna 32 shown in FIGS. 10 and 11 can be shaped to provide an optimally shaped beam with very low sidelobes. It is also of a shape that lends itself to being mounted as an extension from a utility pole.

The longitudinal dimension "a" determines the horizontal beamwidth "h" (FIG. 1). For operation at 10 GHz, with "a" equal to one foot, the horizontal beamwidth is 5°. The vertical beamwidth B should be wider so as to view vehicles from a wider range of aspect angles. This will increase the reflection and provide a doppler return over a longer time period for a good velocity count. If the lateral dimension "b" is five inches, the vertical beamwidth B is 12°.

The antenna 32 includes a tapering four-sided pyramidal horn section 111 feeding toward a parabolically curved sector reflector section 112 having a downwardly curving hood shape. There is a panel 108 of low-loss plastic material which serves as a window for the microwave energy.

In FIG. 12 it is assumed that all the roadways have two lanes and that roadway 166 is a major artery, roadway 168 is a lesser artery, roadway 170 is a major cross street and roadway 172 is a minor cross street. The intersections are all assumed to be interactive. Intersection 165 uses upstream and downstream sensors on roadways 166 and 170, and includes a presence sensor at the intersection on roadway 170 only to insure an accurate stopped vehicle count because this is a lesser roadway. At intersections 171 and 173, roadway 172 does not use upstream and downstream sensors, but only a presence sensor at each intersection, because roadway 172 is a minor road that does not warrant the cost of two sets of sensors. The presence sensor indicated at least one stopped vehicle and how long that vehicle has waited at the "stop" signal. If these roadways contained more than two lanes, each additional lane would have additional sensors.

The upstream and downstream sensors provide vehicular velocity and presence information which is transmitted to the controller site where the three traffic parameters are calculated and compared. The combined summation of parameters for each lane is referred to as a profile. The upstream profile sums AM (Aggregate Momentum), AEC (Aggregate Experienced Congestion) and ASV (Aggregate Stopped Vehicles) which characterizes the traffic either approaching or stopped at the intersection. The downstream profile uses only AEC to characterize downstream congestion.

For interactive intersections such as intersection 165, the running comparison is $P_a - P_e^1 + P_f - P_b^1 - P_d + P_n^1 - P_m + P_c^1$ where $P^1$ includes AEC data only. If the distance between intersections were small, i.e., less than 200 feet, then the entire quad could be assumed to be coupled and then be block controlled by one master controller. In this case, the running comparison is represented by $$P = P_a + P_d + P_h + P_i - P_c - P_b - P_g + P_t + P_w + P_y$$

The specific apparatus to be employed for this embodiment uses hard wired logic circuits, where the logic functions are determined by the wiring of specific circuit elements. It can also use a microprocessor where the logic is determined by the software inscribed into a read-only-memory, ROM. The various implementations will be described in terms of hard wired logic circuits which can, if desired, be translated into software for the alternative microprocessor implementation of this invention. Also various sensor types can be used to provide velocity, vehicle count and vehicle presence time.

This embodiment will utilize a doppler radar sensor. Although this sensor is preferable for its velocity indications, it is not preferable for vehicle presence time or vehicle count. For this reason, the embodiment illustrates a means for approximating vehicle presence time with only a doppler radar. It may nevertheless be desireable to use both a doppler radar and a presence sensor like an inductive loop or an infra red detector, for example, to provide more accurate velocity-length products.

Figures 13A, 13B:
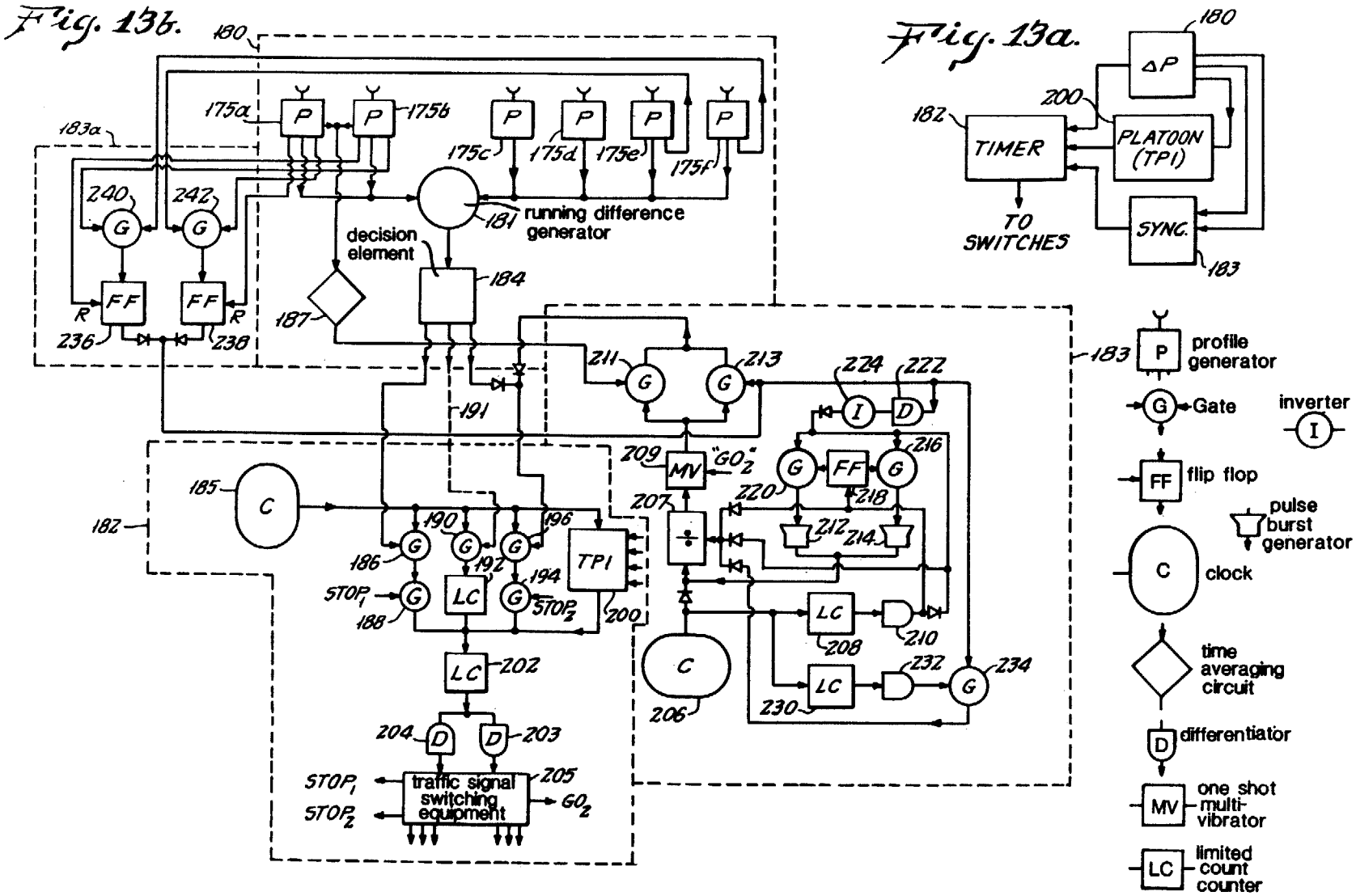
FIG. 13*b*** illustrates one embodiment of control apparatus for a generalized intersection including means for lane profile generation, comparison of roadway profiles, signal timing control, and background progressing sync, block sync, and platoon pre-emptory timing control.

FIG. 13*a* illustrates the timing control philosophy. Timer 182 can be either an electronic clock with a normal, fast and stopped mode or a synchronous motor timer in which a fast mode can be induced by switching to a higher drive frequency. The three timing control elements are profile difference generator (ΔP), 180, tenative platoon identifier, 200, and timing synchronizer, 183. Profile difference generator, 180, exerts control at all times except when overriden by TPI, 200. ΔP, 180, also provides signals that control TPI, 200, and sync control, 183. TPI, 200, indicates the initial arrival of a platoon as quickly as possible using a minimum number of sensors.

When traffic becomes high congested or jammed, it is desireable to introduce block synchronization for those intersections along an arterial or network experiencing such conditions. This block synchronization would also incorporate adaptive split timing control to help increase the velocity of jammed traffic in which greater congestion gets longer "go" time. The block synch reverts back to normal adaptive control when AM rises to specified levels or the traffic becomes free flowing based on samples taken every several minutes. Such adjustable synchronization can be achieved without expensive communications between intersections by using highly accurate quartz crystal oscillators or, where common 60 Hz power lines are available, by using the 60 Hz power line as a common clock source.

FIG. 13*b* illustrates one means by which platoon arrivals, unsynched adaptive, progressive synch, and adaptive block synch, continuously adapt to real time traffic conditions and appropriately control the signals. The control apparatus includes profile generators 175 for each lane of each roadway, the means of comparing profiles 181, a decision element 184, adjustable timing means 182, the progressive and block synchronization generating means 183, and the means for both switching the actual lights and controlling certain fixed sequences such as amber and red overlap times. If, for example, the illustrative intersection were an isolated one, (not on an arterial or in a network), then synch means 183, would not be connected and instead dotted connection 191, would be made. For the case of intersecting arterials, a second synch section would be employed and be connected to gate 186 in a similar fashion such as synch section 183 is connected to gate 196. If block synch is not required, the connecting wire to gate 213, is opened.

Profile generators 175*e* and 175*f* represent downstream congestion for each lane of the arterial. Profile generators 175*a* and 175*b* represent upstream traffic for each lane on the arterial. Profile generators 175*c* and 175*d* represent upstream traffic for the intersecting lesser roadway. Thus representative running sums are compared in difference circuit 181 which in turn feeds arc tangent decision generator 184. Arc tangent decision generator 184, produces a control signal on one of its output arms for each range of running difference magnitudes. The difference magnitude ranges that opens gates 186 or 196 are similar to those described for FIG. 19 except that the minimum magnitude that opens gate 186 is close to zero.

In order to establish that light traffic conditions exist, the outputs from profile generators 175 *a* and *b*, are separately clocked into time averaging circuit 187 where the average AM and AEC is measured over several minutes. If this average falls within a given low range, gate 211 is opened, which initiates the appropriate background progressive synch. This synch can be pre-empted whenever the running difference reach levels appropriate to open gates 186 and 196.

Figure 19:
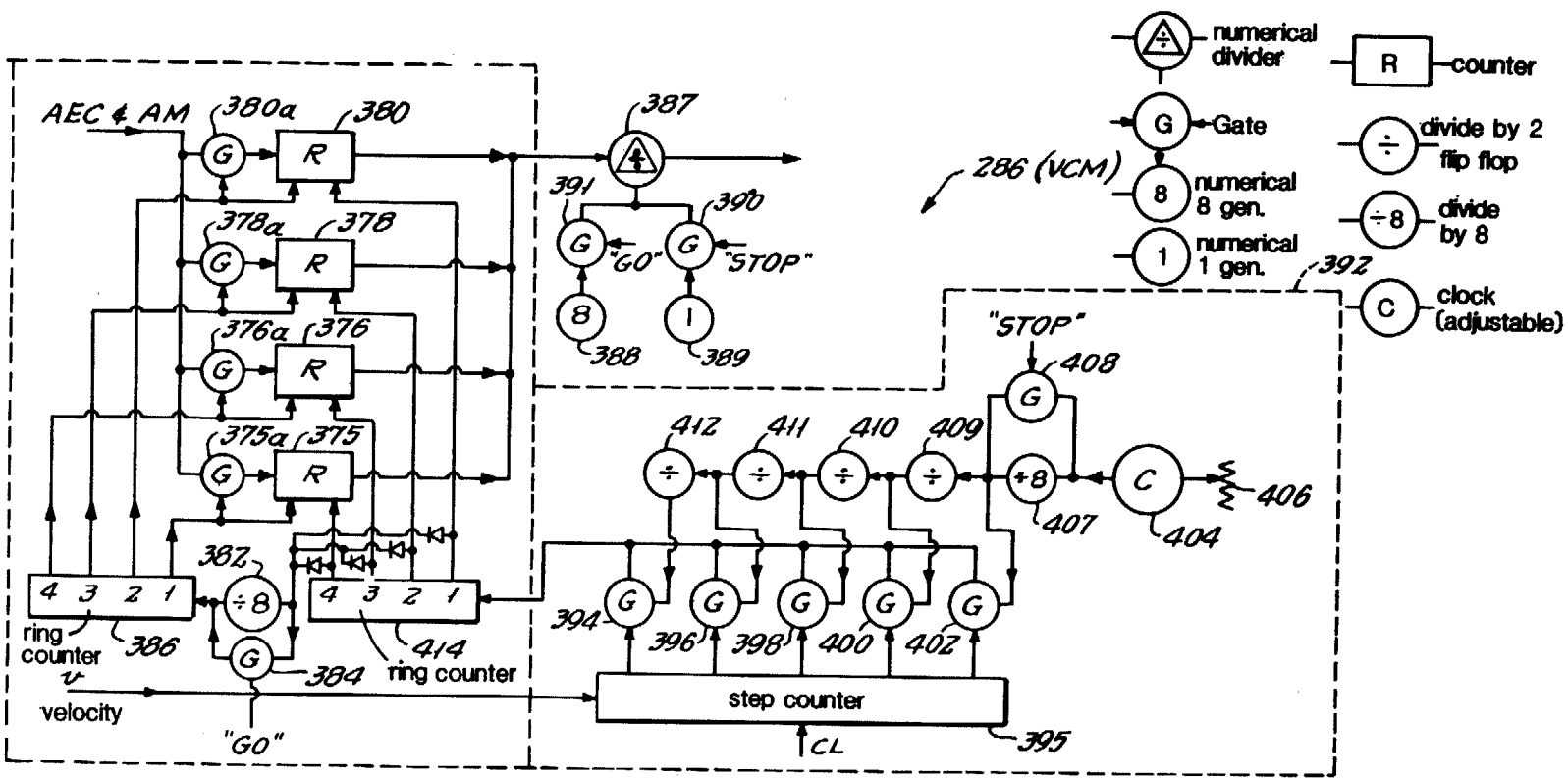
FIG. 19 is a block diagram describing the means for correcting the running sums for vehicles that have passed through the intersection by forecasting each vehicle's trajectory between the sensed zone and the intersection.

Clock 185 and gates 186, 188 thru 196 are described in detail in the discussion of FIG. 19. The middle branch, including gate 190 and LC counter 192, is not connected since its function is taken over by the background synchronization. Gate 196 is associated with the arterial roadway and it is opened by a signal from arc tangent decision generator 184 or a signal from either gate 211 or gate 213. Gate 211 indicates a condition calling for progressive background synch and gate 213 indicates a block synch condition.

The background progressive synch, initiated by opening gate 196 at specific times, quickly switches a "go" signal on the arterial, if a "stop" signal happens to be on. Gate 196 openings are determined by quartz crystal clock 206 and flip flop divider FFD 207. Each time the output of FFD 207 has a positive transition, one short multivibrator 209 is fired and remains fired until a "go" signal switches on which resets multivibrator 209. If the "go" signal is already on, multivibrator 209 continues in its fired state for a preset time period. When multivibrator 209 is not in a fired state, the output from arc tangent generator 184 assumes it normal control as described by FIG. 19.

In order to introduce the progressive offsets, it is necessary to clear FFD 207 at certain precise times of the day and introduce a burst of pulses into FFD 207 which determines the timing offset between intersections. Quartz crystal clock 206 in conjunction with divider 208 and differentiator 210 establish the exact time of day that FFD 207 is cleared. It also selects which burst of offsetting pulses is to be introduced into FFD 207. For this illustrative example, a morning and evening offset is used. The specific offset is determined by flip flop 218 which is in one state in the morning and a second state in the afternoon. One state opens gate 216 and the other state opens gate 220. This allows the impulse from differentiator 210 to trigger the correct burst generator, either 212 or 214. This burst is then inserted into the input of FFD 207.

When heavy congestion is sensed in both the upstream and downstream sensed zones, gates 240 or 242 fires flip flop 236 or 238. Only an increase in the average aggregate momentum levels on those lanes that have experienced high congestion can reset flip flop 236 or 238. When flip flop 236 or 238 is fired, it opens gates 234 and 213. Meanwhile, flip flop divider 230 and differentiator 232 produce spikes at precise intervals every several minutes, as determined by clock 206. When such a spike is fed into open gate 234, FFD 207 is cleared and no offsetting pulses from burst generators 212 or 214 are triggered. By this means traffic signals on all intersections experiencing congestion are brought into block synch. When the congestion clears, flip flop 236 or 238 is reset. When this occurs, differentiator 222 produces an impulse which is inverted by inverter 224. This inverted impulse is applied to gates 216 and 220 and also clears FFD 207. Then depending on the state of flip flop 218, the correct burst generator, 212 or 214, is fired to reset the timing offset on the progressive synch for that time of day.

Figure 14:
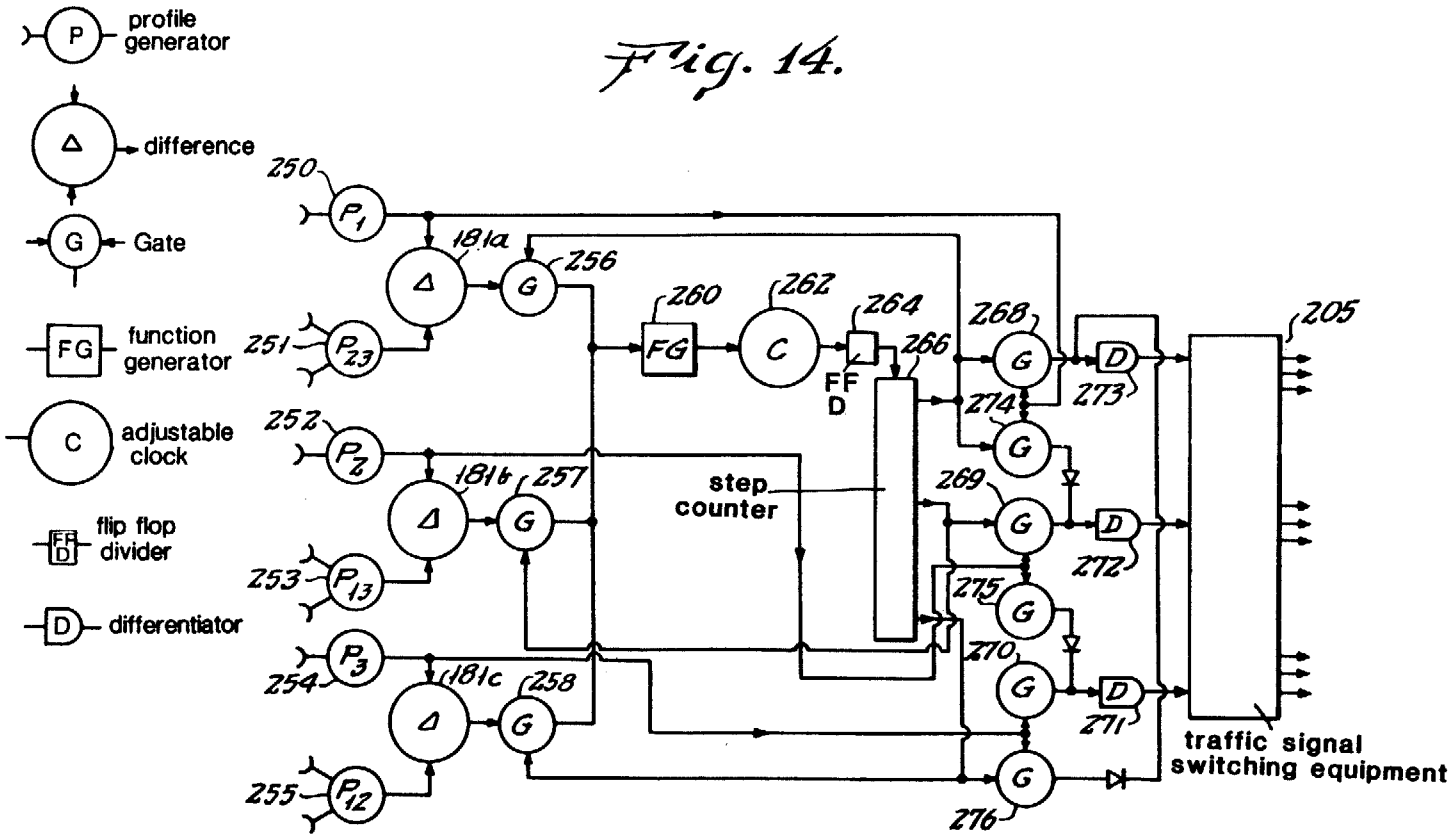
FIG. 14 is a block diagram that illustrates, for isolated three roadway intersections or two roadway intersections with a left turn lane on one roadway, how lane profiles are combined and compared and how timing is controlled.

FIG. 14 illustrates a means by which the signals at a three way intersection or a roadway with left turn signal lanes can be controlled. The running sum for traffic on each designated roadway or lane is generated in profile generators 250, 252 and 254. A grand running sum, that includes a fractionally weighted sum for traffic on all the other lanes or roadways is accumulated in profile generators 251, 253 and 255. The running difference between these profiles is generated in difference circuits 181*a*, 181*b* and 181*c*. This difference for a three roadway intersection is expressed for each roadway as:

$$\Delta_{181} = P_1 - \frac{P_2^1 + P_3^1}{2}$$

$$\Delta_{182} = P_2 - \frac{P_1^1 + P_3^1}{2}$$

$$\Delta_{183} = P_3 - \frac{P_1^1 + P_2^1}{2}$$

where $P_1$, $P_2$ and $P_3$ are "go" signal running sums and $P_1^1$, $P_2^1$ and $P_3^1$ are "stop" signal running sums that include ASV. When either of the three series gates, 256, 257 or 258, is opened by a signal generated by the commutating step counter 266, that corresponding running difference is transferred into function generator 260 which controls the frequency of clock 262 in an inverse manner with relation to the quantity fed into it. For example, a large positive number slows the clock rate. Clock 262 feeds flip flop divider 264 which controls the commutating rate of step counter 266. The voltage generated by each step of step counter 266, fed through normally open gates 268, 269 or 270, opens associated gates 256, 257 or 258. A positive transition from step counter 266 is indicated by differentiators 271, 272 or 273, which initiates a "go" sequence for the corresponding signal in the signal switching apparatus 205.

An unnecessary delay occurs at such intersections when there is no traffic on one or more roadways or lanes and the signal switching sequence continues routinely. A means to skip switching on a green sequence for roads or lanes that have no waiting or approaching traffic, as sensed by the running sum, uses a zero in the running sum in profile generator 250 to close gate 268 and to open gate 274 or similarly in the case of profile generator 252 to close gate 269 and open gate 275 or for profile generator 254 to close gate 270 and open gate 276.

Figure 15:
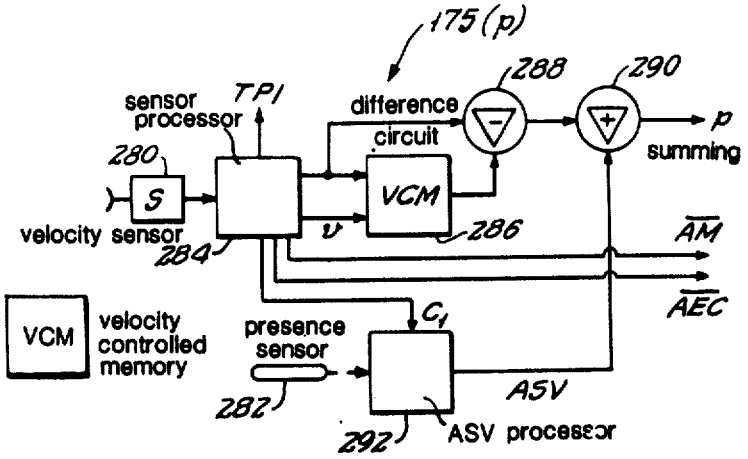
FIG. 15 is a block diagram which illustrates the means for generating a profile for a single lane of traffic, combining AM, AEC, and ASV (to be defined below) into a running sum.

FIG. 15 is a functional block diagram illustrating how the output from a sensor is processed into a traffic profile for a single lane. The output from doppler sensor 280 and optional presence sensor 282 are fed into processor 284. Processor 284 converts the sensor's information into discrete numerical quantities, one being preferably proportional to the product of individual vehicular velocities and vehicular lengths, and the second proportional to the product of individual inverse vehicular velocity factors times vehicular length. The quantities from processor 284 are read into difference circuit 288 in which the running sum is reduced by the stored factors in velocity controlled memory, VCM, 286. The quantity stored in VCM 186 equals the quantity generated by processor 284 for each vehicle except that the quantity is delayed by the time it takes a vehicle to pass from the sensed zone to the intersection zone. This delay is controlled by the vehicular velocity of the last vehicle to pass the sensor in the sensed zone and the traffic signal condition for that roadway. In the "go" mode, after allowing sufficient time for each vehicle to pass from the sensed zone to the intersection zone, the running sum out of processor 284 for each vehicle is subtracted out in difference circuits 288. In the "stop" mode, fractions of the quantity stored in VCM 286 are read out, but at a faster rate. For example, if the read out rate is eight times faster, the fractional magnitude is $\frac{1}{8}$ of the stored quantity in VCM 286. This reflects the gradual reduction in speed of the vehicle as it nears the intersection on "stop" until at the intersection its speed equals zero.

The number of vehicles waiting on a "stop" signal is counted and multiplied by a suitable constant which in effect compares fuel consumption and emissions of stopped vehicles with the average of moving vehicles. This occurs in ASV processor 292. The ASV number is added to the quantity read out of a difference circuit 288, in summing circuit 290. AM and AEC quantities are directly fed out to other control functions.

When all traffic profiles are zero, it is possible to maintain a "go" signal for a preferred roadway by suppressing the zero on the counter used in processor 284. This always maintains a small but non-zero quantity for the running sum on the preferred roadway which under zero traffic or equal conditions will call for a "go" signal on that roadway.

Figure 16:
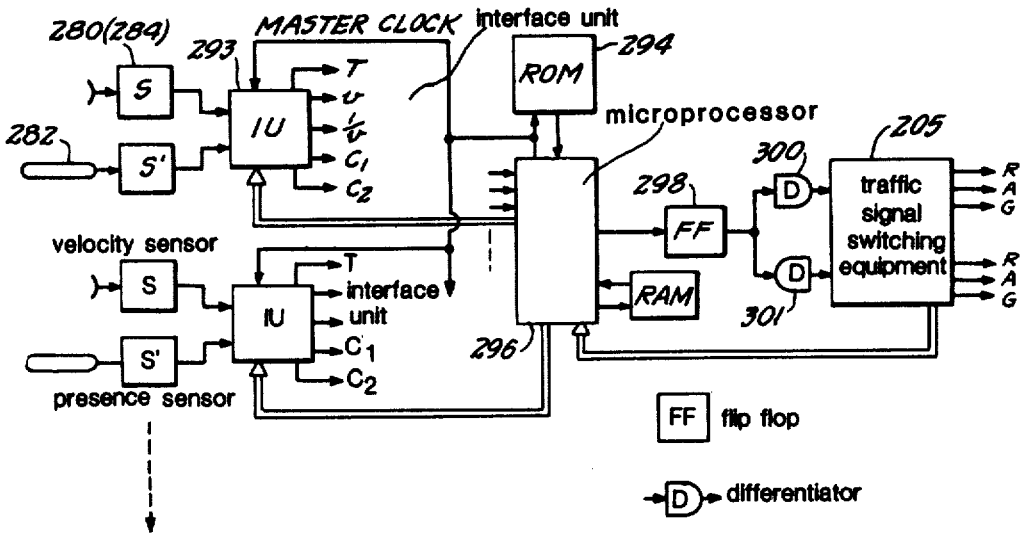
FIG. 16 is a block diagram illustrating how a microprocessor is employed to accept processed analogue data from sensors and control traffic signal switching as described by this invention.

FIG. 16 illustrates how this invention might be implemented with a microprocessor. Sensors and their associated processing equipment remain unchanged. The interface unit 293 converts all the sensor data into numerics. The microprocessor unit 296 converts these numbers into the three parameters and then performs the further operations necessary to control traffic signal timing. The actual control is realized by setting flip flop 298 into either a zero or one state. The transition of flip flop 298 to either state creates a positive or negative pulse in differentiators 300 and 301. These pulses initiate the start sequence of each cycle and split that is carried out in switching apparatus 205. The read only memory, 294, contains the software which is the computer language translation of hard wired logic described in this disclosure.

Figures 17, 17A:
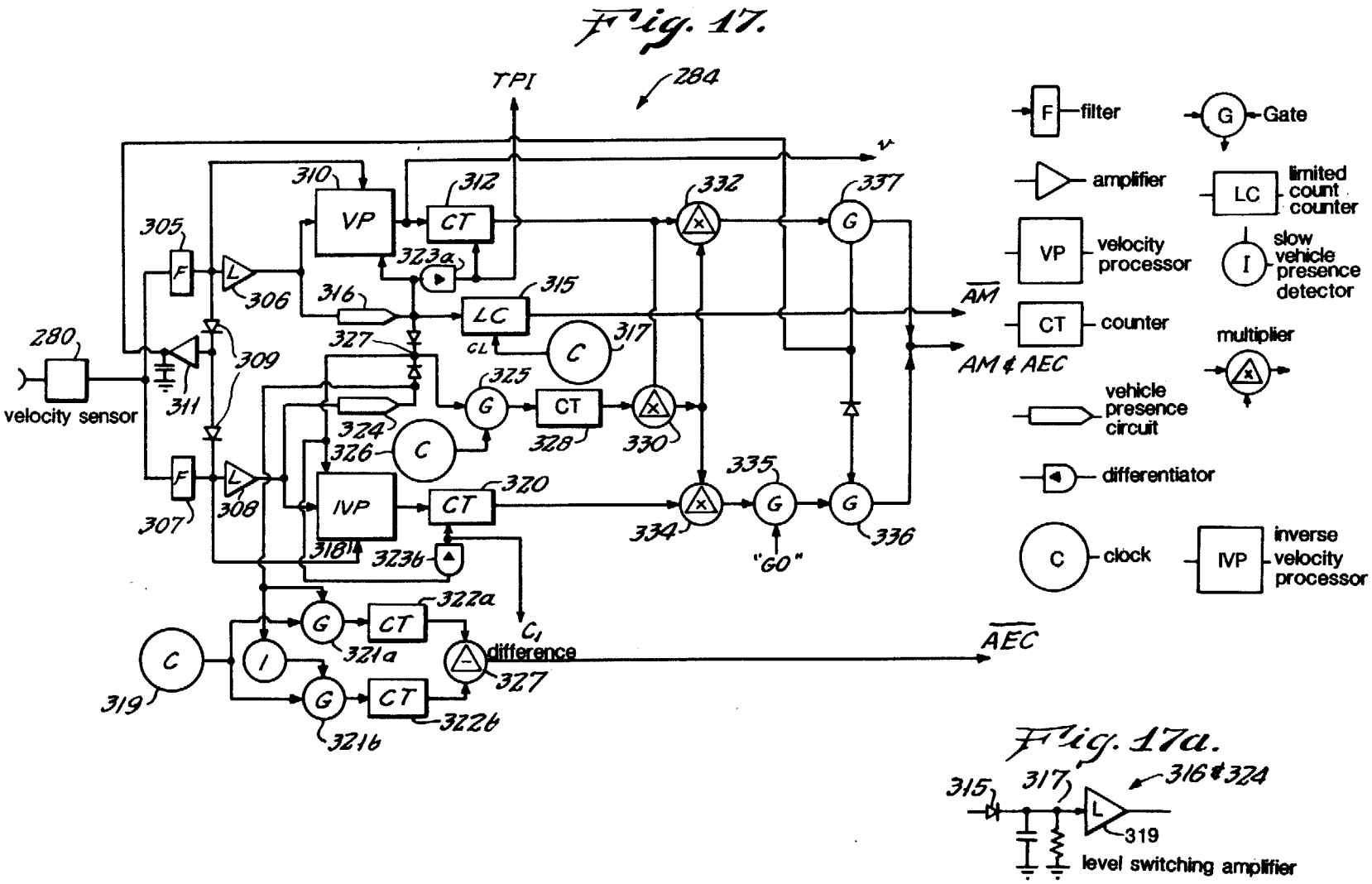
FIG. 17 is a block diagram illustrating a preferred means by which velocity-length and inverse velocity-length products can be generated using doppler signal returns.
FIG. 17A illustrates a vehicle presence circuit.

FIG. 17 is the preferred embodiment of processor 284 generating the following from the doppler data fed to it: velocity-length and inverse-velocity-length products; vehicle counts for ASV, and vehicle counts for TPI; velocity pulse sequences, v, for the VCM processor, AM & AEC preprocessed data from which profiles are generated; and congestion triggered signals that control block synchronization, and the signals that cancel block synchronization. Incorporated in processor 284 is a means for improving the performance of the doppler sensor both insofar as reducing noise and smoothing the randomly fluctuating returns characteristic of viewing vehicles from a 45 degree angle.

Referring to FIG. 17, the output from sensor apparatus 280 is first split into two frequency bands by filters 305 and 307. Filter 305 extends from a frequency corresponding to the doppler frequency of a vehicle travelling at the transitional velocity, $v_o$, up to a frequency equal to the maximum velocity to be considered in controlling signal timing. Filter 307 covers from d.c. up to the low end of filter 305. The output from filter 305 is used for AM computations and the output from filter 307 for AEC computations. The output from each filter feeds limiter amplifiers 306 and 308 respectively. The output from the limiter amplifiers feeds velocity processor 310 and inverse velocity processor 318 where pulse sequences proportional to velocity and inverse velocity are generated. It also feeds vehicle presence circuits 316 and 324. The vehicle presence circuit is illustrated in FIG. 17*a*, consisting of a detector diode, an integration circuit 317, and a level switching amplifier 319. The level switching amplifier is normally cut off. When its input reaches a prescribed level, the amplifier saturates producing zero output voltage. This saturated condition is maintained for a time determined by both the time constant of 317 and the time when the last signal was present from the limiter amplifiers. The time constants correspond to the time that it takes the smallest vehicle to travel through the sensed zone at the highest speed monitored in each range, i.e., 6 mph and 40 mph. If the sensed zone is 3 feet then a 0.16 second and a 1 second time constant would be typical. By this means when there are no signals present, as is often the case from a 45 degree view of a vehicle, the presence circuit, illustrated in FIG. 17*a*, requires only an occasional return from each vehicle to maintain a vehicle presence indication. When no signal is received during the entire integration time period, the vehicle is assumed to have passed through the sensed zone. Better presence data can be obtained from other types of sensors.

The outputs from presence time circuits 316 and 324 are combined through the series "or" diodes at junction 327 where several functions occur. These functions include (1) reading out data from counter 320 and clearing counter 320 by differentiator 323*b*, (2) opening gate 325, (3) feeding presence data to processor 318 and providing vehicle count information to line $C_1$.

The output from presence time circuit 316 feeds vehicle presence data into processor 310 and through differentiator 323*a*. It also reads out data stored in counter 312 and clears the counter. The output from differentiator 323*a* is also used in the tentative platoon identification, TPI, processor. Gate 325 opens during vehicle presence time to feed pulses from clock 326 into counter 328. The stored count in counter 328 is the vehicle presence time in seconds. This time quantity is multiplied in multiplier 330 with the vehicle's numerical velocity which is stored in counter 312. The output from multiplier 330 is vehicle length in feet. This length is fed into multipliers 332 and 334 where it is multiplied with the vehicle velocity stored in counter 310 or the inverse velocity factor $(Vo^2/1+V_m)$ stored in counter 320.

The output from multiplier 332 passes through gate 337, which is opened when the signal out of filter 305 is larger than the signal out of filter 307. The output from multiplier 334 passes through gate 335 which is opened only during "go" signals and then through gate 336 which is opened when the signal out of filter 307 is greater than the signal out of filter 305. The outputs from multipliers are combined to feed velocity-length or inverse velocity-length products out for further processing into AM or AEC.

In order to initiate and cancel block synchronization, as described by FIG. 13, a means is necessary to indicate congestion, and a second means is necessary to indicate reduced congestion so as to cancel block synch. One means of indicating congestion is to sample the output of slow vehicle presence detector 324, and determine vehicle occupancy rate averaged over several minutes. The output of 324 opens gate 321*b* when a slow vehicle is present but opens gate 321*a* when slow vehicles are not present. These gates control the feed of clock 319 into counters 322*a* and 322*b*. The count difference in these counters is accumulated in difference counter 327. Counters 322*a* and 322*b* are cleared every several minutes thereby providing long term congestion averaging. When this difference level exceeds a prescribed limit, over the sample period, a d.c. level is produced at the output of difference circuit 327 which initiates the block synchronization as described in FIG. 13. Once initiated, block synch is cancelled only when vehicular flow rate increases above a certain level. One method of sensing the cancelling condition is to count the number of faster moving vehicles passing through the sensed zone every 60 seconds, for example. Limited count counter 315, which is cleared every 60 seconds by clock 317, counts the number of pulses generated by differentiator 323*a*. When this count exceeds a given level, the output of counter 315 generates a signal that is used to cancel block synch.

Figure 18:
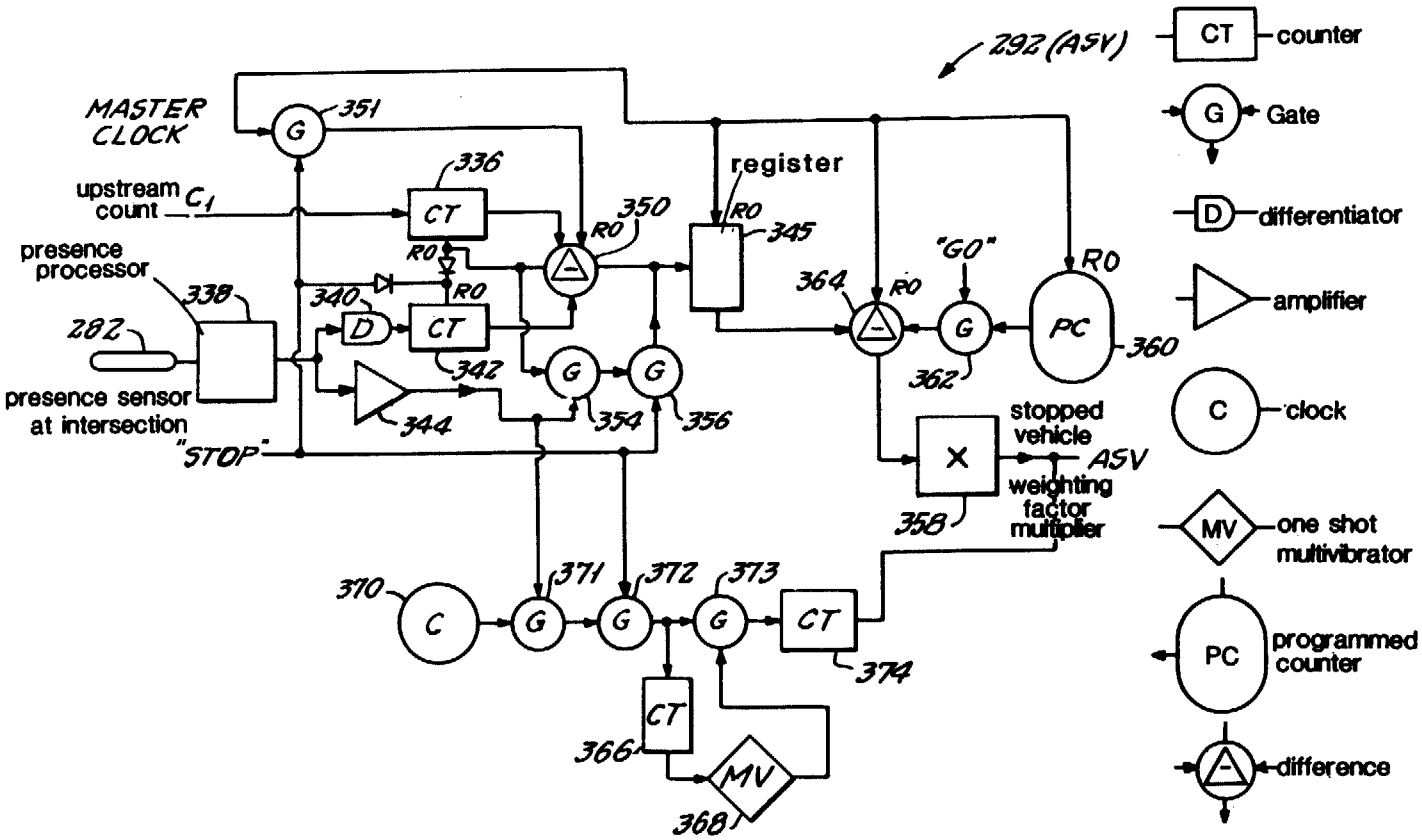
FIG. 18 is a block diagram illustrating a generalized method for generating ASV running sums.

FIG. 18 illustrates the block diagram of a general purpose ASV implementation. It has three modes of operation. One mode provides the most accurate stopped vehicle count but requires a second sensor at the intersection to count vehicles. This mode is recommended for the lesser roadway at intersections with a major route. The second mode uses only the upstream sensor and provides an approximate stopped vehicle count. This would typically be used on the major roadway of two intersecting roadways. The third mode uses only a vehicle presence sensor at the intersection. This is used only on minor roadways. This mode produces a single count regardless of how many vehicles are waiting, but after a given elapsed time with the single count registered, the ASV count is gradually increased by a clock, ultimately forcing a "go" signal.

Mode 1 operates as follows. Counters 336 and 342 register the number of vehicles passing the upstream sensed zone and the intersection zone respectively. The running difference between these counts is taken by difference circuit 350. This count is continually transferred into register 345 by the system master clock during "stop" signal conditions. This transfer is controlled by gate 351. The count is multiplied by the empirical constant, described earlier, in multiplier 358 and fed out as an ASV count. Whenever the count in difference circuit 350 goes to zero, counters 336 and 342 are cleared. A zero count that is also coincident with a "stop" signal and vehicle presence, a condition indicated by opening gates 354 and 346, registers a single count in register 345. This is used as a back up for errors that can occur in the stopped vehicle counting method. When the signal turns green, the difference that has been continually transferred to register 345 stops being transferred and the count in register 345 now remains fixed at the last count registered prior to the signals switch to "go". At this time programmed counter, 360, feeding through gate 362, which is opened on a "go" signal, begins subtracting specified quantities from the number stored in register 345, using difference circuit 364, until the net count equals zero. The count remains at zero until a new cycle starts. The programmed counter 360 feeds out a gradually increasing series of numbers whose time rate of increase approximates the acceleration of vehicles into an intersection after the signal switches to "go".

In the second mode, only counter 336 is used since there is no sensor at the intersection. (Counter 336 is cleared on the switch to a "go" signal.) The operation of mode 2 is similar to mode 1 except that the back up gates 354 and 356 are not operable.

The third mode uses only the presence sensor at the intersection. It does not use counters 336 and 342. The presence of a vehicle on a "stop" signal inserts a single count into register 345. It also opens gates 371 and 372 to pass the signal from clock 370. The clock cycles are counted in counter 366. When a full count is registered, indicative of a long vehicle wait, multivibrator 368 is activated. MV 368, for example, might have a 1 second on and 10 second off time. During the "on" time gate 373 is opened passing the clock signals into counter 374. The number in counter 374 feeds out as an increasing "ASV" count forcing the signal to switch to "go" at the most propitious time. The purpose for multivibrator 368 is to increase the ASV count by small amounts and then wait for a gap in the intersecting roadway's flow of traffic. If this gap doesn't occur in 10 seconds, for example, another increase in the count is generated. This process continues until a "go" signal is activated.

FIG. 19 illustrates the velocity controlled memory VCM, 286 that converts velocity and inverse velocity into AM and AEC. This apparatus consists of the velocity controlled clock 392 and a velocity controlled delay 393. The clock 392 and delay 393 are in this case controlled incrementally. For example, the velocity is broken down into five ranges, 1–2 mph, 2–4 mph, 4–8 mph, 8–16 mph and 16–32 mph. If a vehicle is traveling at 1 mph, it generates one pulse per sampling interval and a vehicle at 32 mph, generates 32 pulses per sampling interval. Step counter 395, has 32 steps wired so that step 1 is wired to gate 394, steps 2 and 3 are wired to gate 396. Steps 4–7 are wired to gate 398, steps 8–15 are wired to gate 400 and steps 16–32 are wired to gate 402. The frequency of clock 404 is adjusted by control 406 to take into account the specific distance between the sensor and the intersection. The output of clock 404 feeds a divide by 8 flip flop 407, for example, which is bypassed by gate 408 when a "go" signal is on. The output of gate 408 and divider 407 feeds a series of divide by 2 flip flops, 409 to 412. Each divide by 2 output is connected to corresponding gates, 394 to 402. The bus that connects the output of all of these gates constitutes the velocity controlled clock's output. The velocity information is retained by counter 395 until the pulse sequence from a new vehicle is detected at which time counter 395 is cleared. During red light conditions, the pulse rate fed into flip flop 409 is increased 8 times for this example. The output bus from gates 394–402 feeds into ring counter 414. Step 1 of counter 414 reads out stored data from counter 380. Step 2 reads out data from counter 414 and connects to divide by 8 flip flop, 382, which is bypassed by gate 384. Gate 384 is opened by a green light signal. The output from 382 and 384 feeds ring counter 386. Step 1 from counter 386 clears counter 375 and reads in new data. Step 2 of ring counter 414 reads out data from counter 378 and steps ring counter 386 to step 2 which in turn clears counter 376 and reads in new data. This sequence continually repeats itself cycling through counters 375–380 such that each counter holds data for a time equal to four steps on ring counter 374. This means that the velocity controlled clock 393 should have a period of T4, where T is the approximate time it takes a vehicle to travel from the sensor to the intersection. The output from counters 374–380 feeds numerical divider circuit 387 in which the digital number read out is either divided by 8, by 388, or divided by 1 by 389 depending on whether the signal is red or amber on gate 391 or green on gate 390. For a green signal, velocity data is stored T seconds and read out. For a red or amber signal condition, the velocity data is read out 8 times faster, for this example, and each number read out is divided by 8.

The velocity controlled clock's rate is determined by the velocity of the last vehicle to pass the sensor. This provides a certain degree of velocity averaging since, for example, in a column of vehicles that is accelerating, the later vehicles will have greater velocity. This increased velocity projects to all the vehicles between the sensed zone and the intersection by the velocity controlled clock's operation.

FIG. 20 illustrates a timing control means which is controlled by the running differences between the various profile generators. The timing control means is comprised of a clock, 185, which drives a network of gates. The status of each gate is controlled by the range in which the profile differences reside, and by traffic signal conditions. These gates are bypassed by tentative platoon identification (TPI) gates. These TPI gates help speed signal reaction time for approaching platoons. The fully implemented timing control circuit illustrated by FIG. 20 would be representative of that used at the intersection of two two-lane arterials.

In this circuit, clock 185 (FIG. 20) drives three parallel branches, two of which are comprised of two series gates 186, 188 and 194, 196. Gate 186 is opened by the presence of "stop" signal on one roadway, $R^1$, which generates a d.c. voltage on "stop" bus 3. Gate 194 is opened by the presence of a "stop" signal on the intersecting roadway, $R^2$, which generates a d.c. voltage on "$stop_2$" bus, 3. Flip flop divider, FFD 192, in conjunction with FFD 202, and differentiating circuits 203 and 204, actuates cycle and split times. For example, a positive transition of FFD 202 produces an impulse at the output of differentiator 203. That impulse initiates signal switching apparatus 205, not described here, which steps preprogrammed switches and timers that carry out the standard sequence required in a cycle. A negative transition of FFD 202 produces a negative impulse which feeds through differentiator 204 and steps other switches and timers through a sequence that initiates the split. The amber timing is determined by the fixed timers in the signal switching apparatus 205 as is the red overlap timing.

Gates 188, 190 and 196 are opened by grand running sum difference magnitudes that fall into certain prescribed ranges. The grand running sum for the two lanes of roadway $R^1$ is generated by profile generators 175*a* and 175*h*. Similarly, the two lanes of roadway $R^2$ are characterized by profile generators 175*i* and 175*j*. The running difference between these sets of profile generators, is generated by difference generator 181. The running difference is preferably processed by an arc tangent function generator, 184 which forces the differences magnitudes into a more controlled range of levels. One of the three outputs from arc tangent generator 184 generates a d.c. voltage when the difference magnitude falls within its specified range. For example, when the arc tangent function is in the range $-30° < \theta < 30°$, the output arm feeding normally open gate 418 and 190 is activated. When $\theta 0$ is in the range, $-90° < \theta < -30°$, which corresponds to roadway $R^2$ having a significantly greater running sum than roadway $R^1$, gate 196 is opened. When $\theta$ is in the range $90° > \theta > 30°$, gate 188 is opened. When the intersection is part of a network or arterial gate 190 is disconnected and the magnitude range used to open the gate corresponding to the lesser roadway might be $90° > \theta > 10°$. When gate 190 is opened, traffic conditions are more or less the same on both roadways. The combination of FFD 192 and 202 would then produce a nominal cycle length, i.e., 60 seconds with a 50% split. When a "stop" signal is on for one roadway and a significantly greater running sum is registered by that roadway, then gates 186 and 188, or 194 and 196 are open and clock 185 drives FFD 202 directly, which speeds up the timer rate and speeds the start of the next cycle or split. Clock 185 and FFD 202 together determine the minimum time duration of a "stop" or "go" signal. When a "go" signal is on for the same conditions, these gates are all closed and the clock in effect stops, thereby holding the "go" signal until a new condition presents itself.

For arterial traffic it is desireable to avoid slowing platoon speed by poorly timed signals. Since sensors are positioned upstream from an intersection, the spacing between the sensor and the intersection may not always be great enough to establish that a platoon is approaching the intersection and initiate the sequence which changes a "stop" signal to a "go" signal without slowing the platoon. The four parallel branches, each with two series gates, provide a means for pre-empting timing control for brief periods when a tentative platoon identifiction, TPI, is made from a limited sample of vehicles by TPI circuit 420. The TPI operates as follows: a "stop" signal on roadway $R^1$ opens gates 430 and 434 and a "stop" signal on roadway $R^2$ opens gates 432 and 436. Tentative platoon identification on any of the lanes of these roadways opens associated gates 438, 440, 442, or 444. If a platoon is tentatively identified on any of the lanes, gate 418 is closed to block any signal that might be on that line. If two platoons simultaneously approach the intersection on both roadways, then one roadway is designated the preferred one by the placement of gates 426 and 428. In this illustration, roadway $R^1$ is the preferred one and a tentative platoon presence on either of its two lanes closes gates 426 and 428 blocking signals on these lines.

A tentative platoon identification is made by TPI circuit 420 illustrated in FIG. 20*a*. Vehicle count pulses are picked up from each of the profile generators, 175*g,h,i,j*. Those pulses fire flip flop 446 and 448 as well as one shot multivibrator 454. A negative transition on flip flop 448 is sensed by differentiator 450 and this fires one shot multivibrator 452. A negative transition will occur after at least three vehicles have been counted. Multivibrator 454 resets flip flops 446 and 448 to their zero state after a given time after the first vehicle is sensed. That time corresponds to the maximum time that three vehicles in a platoon would need to pass the sensed zone. If the three count takes longer than this time, then the registered count is cleared before the third vehicle passes. One shot multivibrator, 452, is set for a fired time period that is deemed minimally necessary for a platoon to establish its control of the "go" signal. If, after that time, control is not established, then it is presumed that the platoon was too small compared to the intersecting traffic condition to take control and normal processes continue.

Although there are other means for generating vehicular velocity and presence information, the doppler radar method has many attractions and it is used as the sensor in this embodiment. FIG. 21 illustrates how the velocity pulse sequence from a doppler radar is generated that takes into account the fluctuating level of doppler radar return from the side view of a complex shaped vehicle while eliminating the possible errors incurred by signal nulls. The doppler beat frequency, which is proportional to vehicular velocity, has been preprocessed so as to produce a pulse for every doppler frequency cycle as described in FIG. 17. These pulses pass through series gates 460 and 462. The presence of a sufficiently strong unprocessed doppler signal level is detected by detector 463 and this magnitude opens gate 460 and gate 464. Gate 464 controls the output from clock 466 feeds counter 468 until the last flip flop stage is activated. This condition closes normally open gate 462. It also activates one shot multivibrator, 469, which has an output pulse duration sufficiently long to allow a fast vehicle to completely pass the sensor. The time constant of MV 469 is extended by presence detector circuit 316 thereby extending the time duration of the inhibit pulse so as to extend beyond actual vehicular presence. The pulse from MV 469 closes gates 460 and 464. When MV 469's pulse goes to zero, the circuit 310 opens to accept new data from the next vehicle. Counter 468 is cleared by the initiation of the inhibit pulse from MV 469.

FIG. 22 illustrates how a pulse sequence proportional to inverse velocity is generated from the doppler signal. When a sufficiently high level of unprocessed doppler signal is detected by detector circuit 470, gate 472 is opened. The processed doppler signals, which have been previously converted into square waves, are fed through gate 472 into differentiator **474*a* in which the positive impulse activates one shot multivibrator 476 and the negative impulse from differentiator 474*a* returns MV 476 to its quiescent state. If the negative impulse does not arrive before a time interval equal to a half cycle of the doppler frequency representing a minimum velocity, i.e. 1 mph, MV 476 returns to its quiescent state on its own to prevent an infinite count. The output of MV 476 opens gate 478 which passes signals from clock 480. It also feeds negative differentiator 482. The negative impulses from 482 fires one shot multivibrator 484 which also controls gate 472. The frequency of clock 480 is selected to produce a pulse rate that generates a number of pulses during a half cycle of the doppler signal for a vehicle traveling at a threshold velocity, i.e., 7 mph, that equals the number of pulses generated by the velocity processor described by FIG. 21 for a vehicle at that same velocity. Multivibrator 484 produces a pulse whose normal time duration would allow an average vehicle to pass through the sensed zone traveling at the threshold velocity, and is extended by presence detector circuit 324** to equal or exceed individual vehicle's presence.

I claim:

1. A traffic control system for controlling vehicular traffic flow at an intersection of roadways with the objective of increasing the average vehicular velocity and reducing the average number of stops without compromising safety or introducing intolerably long delays for adversely affected vehicles comprising:

a multiplicity of sensors positioned for sensing aggregate vehicular momentum and congestion experienced for each of the vehicles passing through a predetermined zone on each such roadway upstream from the intersection, processor means connected to the respective sensors for generating first and second sequences of pulses for each vehicle passing the sensed zone, in which each first sequence is representative of each vehicle's momentum, or preferably, its velocity times its incremental length, and each said second sequence is representative of the congestion experienced by each sensed vehicle, first summing means connected to said processor means for generating a first running sum of the pulses in the successive first sequences, said first running sum being representative of aggregate momentum of the sensed vehicles on the respective roadway, and for generating a second running sum of the pulses in the successive second sequences, said second running sum being representative of the aggregate congestion experiences by the sensed vehicles on the respective roadway, further summing means connected to said first summing means and to said second summing means for generating a third running sum of said first and second running sums for a roadway having a "go" signal and for providing only the first running sum for a roadway having a "stop" signal, means for sensing whether the traffic control light facing a respective roadway is "go" or "stop", forecasting means under control of said go/stop sensing means, and connected to said processor means for forecasting when the sensed vehicles on a respective roadway will likely pass through the intersection and for forecasting when the sensed vehicles on the respective roadway will likely become stopped at the intersection, said forecasting means being connected with said further summing means for subtracting from said third running sum respective portions of said first and second running sums representative of the contribution to aggregate momentum and aggregate congestion of the respective forecasted vehicles for producing a corrected third running sum for each roadway, comparison means for comparing the respective corrected third running sum for each roadway, and light timer means connected and under the control of to said comparison means for lengthening the "go" signal relative to the "stop" signal for the respective roadway having the greater corrected third running sum applicable thereto and for speeding up said timer means if the signal is on "stop" or slowing or stopping said timer means if the signal is on "go".

2. A traffic control system as claimed in claim 1, in which one of the roadways has "go" signal priority, further including:

sensing means for sensing vehicles waiting at the intersection on each other roadway, running summation means connected to said sensing means for producing a running sum representative of the number of vehicles waiting at the intersection on each other roadway during a "go" signal on the priority roadway, multiplying means connected to said running summation means for multiplying said running sum by a constant that relates the fuel consumption and emissions of the waiting vehicles with that of an equivalent number of moving vehicles, said running summation means being connected to said further summing means for said priority roadway for reducing the corrected third running sum for the priority roadway for preventing said timer means from causing too many stopped vehicles on each other roadway from waiting for too long a time for the signal to change from "stop" to "go" for them, and a generator connected to said running summation means and controlled by said signal switching means for reducing said multiplied running sum at a rate that approximates the anticipated rate at which the stopped vehicles will clear through the intersection after the signal changes to "go" for them.

3. A traffic control system for controlling vehicular traffic flow at an intersection that is part of a larger arterial or network of intersections using the means claimed by claim 1, but further comprising:

a second processing means coupled to said processor means which generates data indicative of low traffic density from sensor derived information for the arterial roadway, a clock means which generates time signals indicative of the cycle start time of a coordinated pre-programmed progressive synchronization pattern, a timer control means coupled to said second processing means and said clock means which during coincidence of low traffic density and cycle start time, forces the correct signal condition for the cycle start time, a third processing means which generates data derived from said sensors indicative of extended congestion both upstream and downstream from the intersection, a fixed time duration, block synchronization mode holding means initiated by the third processing means, a second clock means which generates time signals indicative of the cycle start time of the coordinated block synchronization pattern, a second timer control means coupled to said light timer means which during the coincidence of a block synchronization period and the cycle start time indication of the block synchronization clock adjusts said light timer means to force the correct signal condition for each such cycle start time, a sampling means for indicating traffic conditions at the end of the block synchronization hold period and when uncongested conditions are indicated for some period thereafter, the timing control reverts back to progressive sync.

4. The system as claimed in claim 1, but including a means to pre-empt control when a platoon of vehicles is approaching the intersection comprising;

a processor which identifies the first vehicle of a tentative platoon from a limited sampling of vehicles that includes both the velocity and density of that sample of vehicles, a switch means, which is activated for a limited period after the identification of a tentative platoon, that pre-empts control of the timing means so that during the coincidence of tentative platoon identification (TPI) and a "stop" signal, the timer is sped up and during the coincidence of TPI and a "go" signal, the timer is slowed or stopped.

5. A traffic control system that takes into account energy consumption and emissions of moving and stopped vehicles comprising:

a velocity indicating sensor and a presence sensor that monitor a specified narrow segment of roadway for producing velocity data and presence time data for each vehicle passing said segment of roadway, multiplication means connected to said sensors which multiplies the velocity data by the presence time data resulting in a vehicle length indication for each such vehicle, first processing means connected to said multiplication means for generating aggregate momentum data which is comprised of the running sums of velocity data times said length indication for each such vehicle between the segment of roadway and an intersection, second processing means connected to said multiplication means for generating aggregate congestion data which is comprised of running sums indicative of inverse velocity data for each vehicle times each vehicle's length indication for each such vehicle present between the segment of roadway and the intersection, third processing means connected to said multiplication means for generating aggregate stopped vehicles data which is comprised of the running sum of vehicle length indications for each vehicle which has passed said segment of roadway and is waiting at a stop signal, and means for controlling traffic connected to said first, second and third processing means for controlling the traffic as a function of said aggregate momentum data, said inverse velocity data and said aggregate stopped vehicles data for minimizing energy consumption and emissions of moving and stopped vehicles.

6. A traffic control system as claimed in claim 5, in which:

said velocity indicating sensor and said presence sensor are comprised of a doppler radar velocity sensor and an infra red presence sensor, respectively, whose respective sensing beams are focused on the same segment of roadway.

7. A traffic control system, as claimed in claim 5 in which:

said velocity indicating sensor and said presence sensor are comprised of a doppler radar velocity sensor and an inductive loop detector presence sensor, respectively, located so that their sensed zones are coincident at the same segment of roadway.

8. A traffic control system for controlling vehicular traffic at the intersection of more than two multiple roadways or at an intersection with phased left turn intervals is comprised of;

a multiplicity of sensors located upstream from the intersection on each intersecting roadway or left turn lane, a multiplicity of processors for converting the sensed data into aggregate momentum, aggregate congestion and aggregate stopped vehicle parameters, a first summing means for adding said parameters together for the roadway or lane with a "go" signal condition, a second summing means for adding stopped vehicle parameters for the roadways and lanes with a "stop" signal condition, a first difference means for subtracting the second sum from the sum for that roadway with a "go" signal condition, a timer means whose rate is controlled to be inversely related to the first difference, and a logic means for skipping "go" phases for roadways and lanes whose first sum equals zero just prior to its anticipated switch from a "stop" to "go" condition.

9. A method for controlling the timing of "go" and "stop" traffic signals at an intersection of at least two roads comprising the steps of:

at an upstream zone sensing each approaching vehicle's momentum and congestion factors, such congestion factors being representative of the congestion being experienced by each vehicle on each lane of each road, producing for each lane a first pulse count representing the momentum factor of each vehicle on each respective lane between the sensed zone and the intersection during a "go" signal, summing the first pulse counts for each lane for producing a first running summation for each lane indicative of aggregate momentum during a "go" signal, producing for each lane a second pulse count representing the congestion factor of each vehicle on each respective lane between the sensed zone and the intersection during a "go" signal, summing the second pulse counts for each lane for producing a second running summation indicative of aggregate congestion being experienced by each vehicle approaching the intersection on the respective lane during a "go" signal, decreasing both the first and second summations for each lane by subtracting from the respective first and second running summations the respective first and second pulse counts for vehicles on the respective lane which have passed through the intersection during the "go" signal for producing a corrected first running summation and a corrected second running summation for the respective lane, adding said corrected first running summation and said corrected second running summation for all of the lanes on a road during a "go" signal for that road for producing a first grand running summation for the road having a "go" signal, said first grand running summation being representative of the aggregate momentum and aggregate congestion of vehicular traffic on all of the lanes of said road having a "go" signal, producing for each lane of the road having a "stop" signal (the other road) a third pulse count representing the aggregate momentum factor of each vehicle on each respective lane approaching the intersection during a "stop" signal, summing the third pulse counts for each lane of said other road for producing a third running summation indicative of aggregate momentum for each lane during a "stop" signal only, decreasing said third running summation for each such lane by subtracting from said third running summation the respective pulse counts for vehicles on the respective lane which have slowed down and stopped during a "stop" signal for producing a corrected third running summation, adding said corrected third running summations for all of the lanes of said other road during a "stop" signal for that road for producing a second grand running summation for the road having a "stop" signal representative of the aggregate momentum of vehicular traffic on all of the lanes of the road having a "stop" signal, continuously comparing said first grand summation with the second grand summation during said "go" and "stop" signals, and lengthening the "go" signal relative to the "stop" signal for the respective road having the greater grand summation.

10. The method as claimed in claim 9, wherein the steps of producing said aggregate momentum first summation and said aggregate congestion second summation are comprised of:

storing the individual vehicle velocity and inverse velocity data bytes, for vehicles as the vehicles are sensed, reading out this stored data in a commutating fashion, including the steps of clearing to zero and reading in new data, such that each new byte is stored for a time period equal to a single commutation cycle, where during a "go" signal, the commutating rate approximates average vehicular velocities divided by the distance between said upstream zone and the intersection, and where each data storage element is cleared to zero as its commutating period is completed, where during "stop" signals, the read out rate is speeded up and where each byte magnitude read out is divided by a number equal to the speed up factor, where the shortened read out time interval equals the above "go" signal commutation time period divided by the speed-up factor and where the fractional magnitudes are continually subtracted from the remaining stored magnitude until the stored magnitude equals zero, which provides a linear forecast approximation of the vehicle's slowing down and stopping at the intersection on a stop signal, and where prior to the start of the next commutation cycle, after the forecasted velocity and inverse velocity sum goes to zero, that memory element is cleared and new data is read into it.

11. The method as claimed in claim 9, including the further step of adding a fourth pulse count to the third pulse count, said fourth pulse count representing the number of vehicles stopped at a "stop" signal (queue) times an empirical constant that relates fuel consumption and emissions of stopped vehicles to that of moving vehicles, and after the change from a "stop" signal to a "go" signal, gradually reducing said fourth count to zero at a rate reflecting the time needed to clear the previously stopped vehicles through the intersection.

12. The method for controlling the timing of traffic signals as claimed in claim 9 or 11, including the steps of:

sensing vehicle velocity and duration of the vehicle's presence, as each vehicle passes over said upstream zone, multiplying each vehicle's sensed velocity and sensed presence duration for generating a factor indicative of each vehicle's length, and modifying said first and second pulse count by said factor indicative of the length of the respective vehicle to which said first and second count applies.

13. The method as claimed in claim 9 or 11 including the further step of:

sensing downstream congestion from the intersection for a non-isolated intersection, and subtracting a running pulse count indicative of downstream aggregate congestion from the second running summation indicative of aggregate congestion being experienced upstream of the intersection for that road during a "go" signal for that road.

14. The method as claimed in claim 9 or 11, wherein said first pulse count representing the momemtum factor of each vehicle is produced by multiplying a term indicative of each vehicle's velocity by a term indicative of each vehicle's length.

15. The method as claimed in claim 9 or 11, wherein said second pulse count representing the congestion factor of each vehicle is produced as a function of the inverse velocity of the vehicle as it passes through said upstream sensing zone.

16. The method as claimed in claim 15, in which said second pulse count representing the congestion factor of each vehicle is produced as a function of a term indicative of the inverse velocity of the vehicle as it passes through said upstream sensing zone multiplied by a term indicative of the length of the respective vehicle.

17. The method for adapting the method as claimed in claim 9 or 11, for functioning in an arterial and network intersecting roadway system comprising the steps of:

sensing uncongested traffic conditions on the arterial roadway, and also indicating the cycle start time of a pre-programmed progressively synchronized signal light timing pattern for this system, then forcing the signal condition required at the start of such cycle to occur when the two conditions of uncongested traffic and cycle start time are coincident, and concurrently sensing a continuing traffic congestion condition occurring simultaneously downstream and upstream from the intersection, and also indicating the start of a block synchronized cycle time coordinated with adjacent intersections, and when the congested traffic indication and the block synchronized cycle start time are coincident, preempting the control from said progressive synchronized timing pattern, thereby initiating and holding a cycle start block synchronized pattern for some extended minimum time, regardless of momentary changes in traffic conditions, and during this minimum time forcing the required signal condition at the start of each block synchronized cycle and after the minimum block synchronized mode hold time has expired and if congested conditions persist, this mode is extended and if uncongested conditions exist, control reverts to the pre-programmed progressive synchronized pattern.

18. The method as claimed in claim 9 or 11, wherein the traffic at said intersection involves left turn sequences including the further steps of:

generating a first running sum for the roadway or lane with a "go" signal as a function of that roadway's or lane 's aggregate momentum and aggregate congestion, subtracting from said first running sum a second running sum generated as a function of the fractionally weighted running sums of aggregate momentum plus the number of stopped vehicles, for each of the roadways or lanes that have a "stop" signal, and using the difference between the "go" roadway's or lane's running sum and all the "stop" roadway's or lane 's fractionally weighted running sums for inversely controlling the "stop" and "go" timing rate, which in turn controls the duration for that roadway's "go" signal.

19. The method as claimed in claim 18, including the further step of:

skipping a "go" signal for a particular road when there is no traffic on said particular road

20. The method as claimed in claim 9 or 11, including the further steps of:

predetermining that a particular road at said intersection is a "priority" road, and biasing said continuous comparing in favor of said priority road for assuring that said priority road will receive a "go" signal for a predetermined minimum duration exceeding the usual duration in case of zero traffic approaching said intersection on all roads and also in case of equal traffic conditions on all roads approaching said intersection.

21. A method for controlling the timing of "go" and "stop" signals at an intersection of at least two roads, comprising the steps of:

measuring each vehicle's presence-duration and its velocity as it passes over a narrow strip of roadway located upstream from the intersection, estimating each vehicle's momentum factor and experienced congestion factor from said presence-duration and velocity information, then summing said factors to generate first and second running sums, projecting forward both the velocity and time of arrival of each vehicle at the intersection from the sensed velocity for that vehicle and the traffic signal condition and the distance between said strip and the intersection, cancelling those momentum and congestion factors from the respective running sums for vehicles that have passed into the intersection, counting the number of vehicles stopped at the intersection during a "stop" signal condition, and then multiplying said count by a predetermined constant that establishes an equivalence between stopped and moving vehicles, as a function of the relative fuel consumption and emissions for running vehicles and for stopped vehicles with idling engines for producing the stopped vehicle factors, summing aggregate momentum and congestion factors for that roadway with a "go" signal condition for creating one grand running sum, summing together aggregate momentum and stopped vehicle factors for that roadway with a "stop" signal condition for creating a second grand running sum, and comparing said first and second grand running sums in order to create a running difference for controlling the length of the "go" signal duration relative to the "stop" signal duration for causing the roadway with the larger grand running sum to receive the longer "go" signal duration.

22. The method of controlling the timing of "go" and "stop" signals at an intersection, as claimed in claim 21, including the further step of:

causing said stopped vehicle count to decrease toward zero upon a change in signal from "stop" to "go" by a running subtraction accounting for the passage of each previously stopped vehicle into the intersection.

23. The method for controlling the timing of "go" and "stop" signals at an intersection, as claimed in claim 43 or 44, for the case of multiple intersections in proximity to each other, comprising the further steps of:

sensing each vehicle's velocity as it passes over a narrow strip of a roadway downstream from the first intersection proceeding toward a second intersection downstream from the first intersection and in proximity to the first intersection, estimating each vehicle's downstream experienced congestion factor on said roadway from said sensed velocity, summing said downstream experienced congestion factors for the vehicles on said roadway to generate a third running sum, and subtracting said third running sum from said first grand running sum for said roadway.

24. The method as claimed in claim 21 or 22, including the further steps of:

determining the density on a roadway approaching the intersection of a relatively few vehicles, making tentative platoon identification based upon the sensed velocities of said few vehicles and their density, and upon tentative identification of a platoon modifying the traffic signal timing by lengthening the duration of the "go" signal facing said roadway or by shortening the duration of the "stop" signal facing said roadway.

25. The method as claimed in claims 21 or 22, including the following further steps for adapting said method to the case of interconnecting roadways that form arterials and networks:

predetermining the preferred directions of traffic flow for the various times of the day and predetermining the distances between the respective intersections along the roadways in the respective preferred directions, predetermining a limit value of the congestion factor on the roadway in the respective preferred direction below which the traffic shall be considered as "free flowing", when the traffic is "free flowing" controlling the traffic signals at the respective intersections along a roadway in the preferred direction for providing synchronized progressive offsets of the "go" signals along that roadway favoring the predetermined direction of traffic flow for that time of day, and when the congestion factor exceeds said predetermined limit both upstream and downstream from a given intersection providing a modified synchronization pattern and continuing said pattern for a predetermined period.

26. The method as claimed in claim 21 or 22, including the following further steps of adapting said method to intersections of three or more roadways and to intersections with phased left turns, eliminating said step of comparing said first and second grand running sums, generating a running ratio whose numerator is the grand running sum for that roadway having the "go" signal condition and whose denominator is the total of all of the grand running sums for all of the other roadways at said intersection (the other roadways being those other than the roadway having the "go" signal condition), said denominator being multiplied by a constant approximately equal to the reciprocal of the total number of said other roadways represented in the denominator, controlling the timing of the traffic signal at the intersection for producing a "go" signal duration for that roadway which is inversely proportional to said ratio, and skipping a "go" signal for that roadway whenever the grand running sum applicable to that roadway is zero.

27. A traffic signal adaptive timing control system comprising:

sensors positioned at least 100 feet upstream from an intersection for sensing the velocity and presence duration time of vehicles passing over a narrow segment of roadway near the respective sensor, a traffic signal means at said intersection for controlling the traffic at said intersection, processing means located near the intersection for multiplying the sensed velocity and sensed presence duration time of each vehicle for generating data indicative of the length of each vehicle and for multiplying said vehicle length data times the sensed velocity for each vehicle for generating data indicative of the momentum of each vehicle and for summing said momentum data for the sensed vehicles on each roadway for generating aggregate momentum data for the vehicles approaching the intersection on each respective roadway, and for generating inverse velocity factor data for each vehicle and for multiplying said inverse velocity factor data times said vehicle length data for each vehicle for generating data indicative of the congestion being experienced by each vehicle and for summing said congestion data for the sensed vehicles on each roadway for generating aggregate experienced congestion data for the vehicles approaching the intersection on each respective roadway, and for multiplying the number of vehicles forecasted to have been stopped on a respective roadway during a "stop" signal times an empirical constant representative of fuel consumption and pollution caused by a stopped vehicle relative to a moving vehicle for generating aggregate stopped vehicle data for each respective roadway near the intersection during a "stop" signal and then for progressively reducing said aggregate stopped vehicle data for the respective roadway after the signal has changed to "go" for changing said aggregate stopped vehicle data to reflect previously stopped vehicles that have cleared through the intersection, and for determining the number of sensed vehicles on each respective roadway which have passed the segment of roadway during a current predetermined time interval for generating data indicative of a tentatively identified platoon approaching said intersection on the respective roadway, transmission means connected with said sensors and associated with said processing means for forwarding sensed information from said sensors to said processing means, a traffic signal timer for controlling said traffic signal means, said processing means being connected to said timer, sum comparison means in said processing means for providing running sum comparisons of said aggregate data to determine the roadway having associated therewith a significantly larger running sum, said sum comparison means generating a control signal that stops said traffic signal timer to hold a "go" signal for said roadway having the larger running sum associated therewith, that speeds up said traffic signal timer when a roadway having a "stop" signal has the larger running sum associated therewith and that allows the timer to run at its normal rate when there is no significant difference in running sums, and said sum comparison means generating a second control signal which upon coincidence with tentative platoon identification data and a "go" signal stops said traffic signal timer for a predetermined time, and upon coincidence of tentative platoon identification data and a "stop" signal speeds up said traffic signal timer for a predetermined time.

28. A traffic signal adaptive timing system, as claimed in claim 27 and being arranged for intersections that are part of an arterial or network system, comprising:

means for generating a first set of clock signals that indicate the start of each cycle for a progressively synchronized timing pattern that ties that intersection's timing to other intersections in the roadway system and where the preferred direction of travel can be switched depending on time of day, means for generating a second set of clock signals that indicate the start of each cycle for a block synchronized timing pattern, time averaging means connected to said sensors for establishing whether congested or uncongested traffic conditions exist on the roadway and during congested conditions said time averaging means generating a time latched first voltage for a fixed time, and during uncongested conditions generating a second voltage, and logic means connected to said time averaging means and to said timer which establishes coincidence of the congested condition first voltage and the cycle-start-time indication-for-block-sync, for generating a third control voltage that adjusts the timer to produce the desired signal condition at the cycle start and during coincidence of the uncongested condition second voltage and cycle-start time-indication-for-progressive-sync, for generating a fourth voltage to speed up said timer to quickly bring on the cycle starting signal condition.

* * * * *